US005850182A

United States Patent [19]

Schuler

[11] Patent Number: 5,850,182

[45] Date of Patent: Dec. 15, 1998

[54] DUAL WAVELENGTH FIRE DETECTION METHOD AND APPARATUS

[75] Inventor: Fred Schuler, Lakeville, Minn.

[73] Assignee: Detector Electronics Corporation, Minneapolis, Minn.

[21] Appl. No.: 779,723

[22] Filed: Jan. 7, 1997

[51] Int. Cl.[6] ..... G08B 17/12

[52] U.S. Cl. ..... 340/578; 250/339.15

[58] Field of Search ..... 340/578, 577; 250/339.15, 340

[56] References Cited

U.S. PATENT DOCUMENTS

| | | | |
|---|---|---|---|
| 3,824,391 | 7/1974 | Noltingk et al. | 340/578 |
| 3,859,520 | 1/1975 | Hertzberg et al. | 250/226 |
| 3,940,753 | 2/1976 | Müller | 250/338.1 |
| 4,101,767 | 7/1978 | Lennington et al. | 250/339.04 |
| 4,160,163 | 7/1979 | Nakauchi | 250/339.15 |
| 4,206,454 | 6/1980 | Schapira et al. | 340/578 |
| 4,220,857 | 9/1980 | Bright | 250/339.15 |
| 4,280,058 | 7/1981 | Tar | 340/578 |
| 4,296,324 | 10/1981 | Kern et al. | 250/339.15 |
| 4,357,534 | 11/1982 | Ball | 250/339.15 |
| 4,414,542 | 11/1983 | Farquhar et al. | 340/578 |
| 4,421,984 | 12/1983 | Farquhar et al. | 250/339.04 |
| 4,463,260 | 7/1984 | Ikeda | 250/339.15 |
| 4,533,834 | 8/1985 | McCormack | 250/339.15 |
| 4,553,031 | 11/1985 | Cholin et al. | 250/339.15 |
| 4,639,598 | 1/1987 | Kern et al. | 250/339.15 |
| 4,691,196 | 9/1987 | Kern et al. | 340/578 |
| 4,742,236 | 5/1988 | Kawakami et al. | 340/578 |
| 4,785,292 | 11/1988 | Kern et al. | 340/578 |
| 4,866,420 | 9/1989 | Meyer, Jr. | 340/578 |
| 5,373,159 | 12/1994 | Goldenberg et al. | 250/339.15 |
| 5,594,421 | 1/1997 | Thuillard | 340/578 |

FOREIGN PATENT DOCUMENTS

| | | |
|---|---|---|
| 1 550 334 | 8/1979 | United Kingdom . |

*Primary Examiner*—Thomas J. Mullen, Jr.
*Assistant Examiner*—John Tweel, Jr.
*Attorney, Agent, or Firm*—Merchant, Gould, Smith, Edell, Welter & Schmidt, P.A.

[57] ABSTRACT

A method for extracting a number of temporal frequencies occurring in a fire and false fire condition concurrently from two or more radiation detectors for receiving signals, a correlation detector for each frequency and sensor, and a storage buffer for the temporal frequencies extracted and sensors employed, so as to distinguish a small fire signal in the presence of a much larger false fire signal whether random in nature or not. The ratio of each extracted frequency following proper qualification is compared to the ratio band for fire and an output signal is generated when the ratio at one or more temporal frequencies indicates a fire.

28 Claims, 21 Drawing Sheets

$$A = sn_3\ k\ 200^2 \qquad s_j = \frac{A}{sn_j\ k}$$

DUAL WAVELENGTH FIRE DETECTION METHOD AND APPARATUS

BACKGROUND OF THE INVENTION

The invention relates to the detection of radiation of fire when there is also present radiation from one or more false fire sources of arbitrary temporal characteristic. Embodiments of the invention result in improved ability to detect small fires in the presence of relatively large false fire sources especially when two or more wavelengths are employed.

Previous embodiments employ a variety of wavelength strategies. In systems employing two or more wavelengths, the wavelength sets are normally chosen to maximize the variation in ratio in radiation received from fire to false fire sources in the chosen wavelengths. Output from each sensor employed is equal to the sum of the total radiation received and the intrinsic noise sources over a given temporal band.

For example, FIG. 1 shows the spectral radiant emittance of a blackbody at various temperatures. It will be noted that at a temperature of 600 degrees K, a typical temperature for fire detection, the spectral radiant emittance curve is relatively flat in the area of 4 to 5 microns. Thus, a detection system which employs one detector at, say, 4.5 microns and a second detector at 5.0 microns will produce a ratio close to 1.

In comparison, FIG. 2 shows a spectral radiant emittance curve from a Bunsen flame. In contrast to the blackbody curve, it will be noted that the fire source curve is not at all flat across wavelengths. In particular, a system employing one detector at the curve maximum, 4.5 microns, and a second detector at 5.0 microns, would produce a ratio 4.5/5.0 microns much larger than 1.

Often autocorrelation and/or crosscorrelation is performed on the outputs from the various sensors in order to eliminate or identify the intrinsic noise sources. The total radiation falling on each sensor in each of the chosen wavelengths remains highly correlated (normally the case when the chosen wavelengths are very close to each other, and somewhat less as the wavelengths become separated reflecting the differences in the molecular action of the irradiating substance). Thus, the ratio calculated reflects the ratio of the total radiation received in those wavelengths.

A problem arises when the total or correlated radiation, regardless of temporal character, in the chosen wavelengths comprises relatively large false fire source energy compared to concurrent fire source energy, as the ratio generated tends to the false fire ratio and the system thus ignores the fire hazard.

Consider the fact that a radiation detector's output reflects the total input radiation from any number of sources radiating at the proper wavelengths. Thus, without some further method of decomposition, it is not possible to discriminate the various sources by simply viewing the total detector output power.

As an example, suppose the ratio of the output of two detectors viewing two different wavelength bands is one for false fire alone and three for fire alone. Suppose that the signal on the numerator wavelength is composed of 50 units of false fire and 9 units of fire while the denominator wavelength is composed of 50 units of false fire and 3 units of fire. The total correlated strength of the numerator is, therefore, 59 while the denominator is 53. The ratio is, therefore, $^{59}/_{53}$ or about 1.113.

It is not likely that such a small variation from the ideal of one could be categorized as fire having the ideal of three.

In order for the ratio to attain just two in this example the fire in the numerator must grow to three times the size of the false fire in the numerator. In other words, this would be a ratio of (50+150)/(50+50)=2.

Thus, in practice a fire detector employing two or more wavelengths and using a ratio of two or more wavelengths even when time correlated cannot respond to a fire until the fire size is more or less comparable to the false fire sources or greater. Only at this time is the radiation of the fire sufficient to generate a "fire ratio." In spite of a detector employing two or more wavelengths to easily distinguish between fire and false fire when occurring alone at great distance, when used in an application where both occur simultaneously, the fire sensitivity is greatly diminished.

This serious limitation is overcome by further decomposition of the total detector output power. One way this can be accomplished is by abstracting the radiation signals received from fire and false fire sources concurrently over a time interval in two or more wavelengths as the superposition of a number of (temporal) sources input simultaneously.

Each of these sources contributes to the total output of each detector channel employed but can be extracted and analyzed (ratioed) independently. A new detection method is thus created which generates not one ratio, but a ratio for each source concurrently radiating the pair of detectors.

SUMMARY OF THE INVENTION

According to the described invention, in the above example, it is quite possible to be able to generate both a ratio of one (50 false fire units numerator/50 false fire units denominator) and three (9 fire units numerator/3 fire units denominator) at the same time. The detector logic would then recognize the ratio three as that of a fire and produce an alarm output even though the total correlated signal strength is about seven times the total fire strength. (Numerator wavelength)

DETAILED DESCRIPTION OF THE PREFERRED EMBODIMENTS

Figure 3:
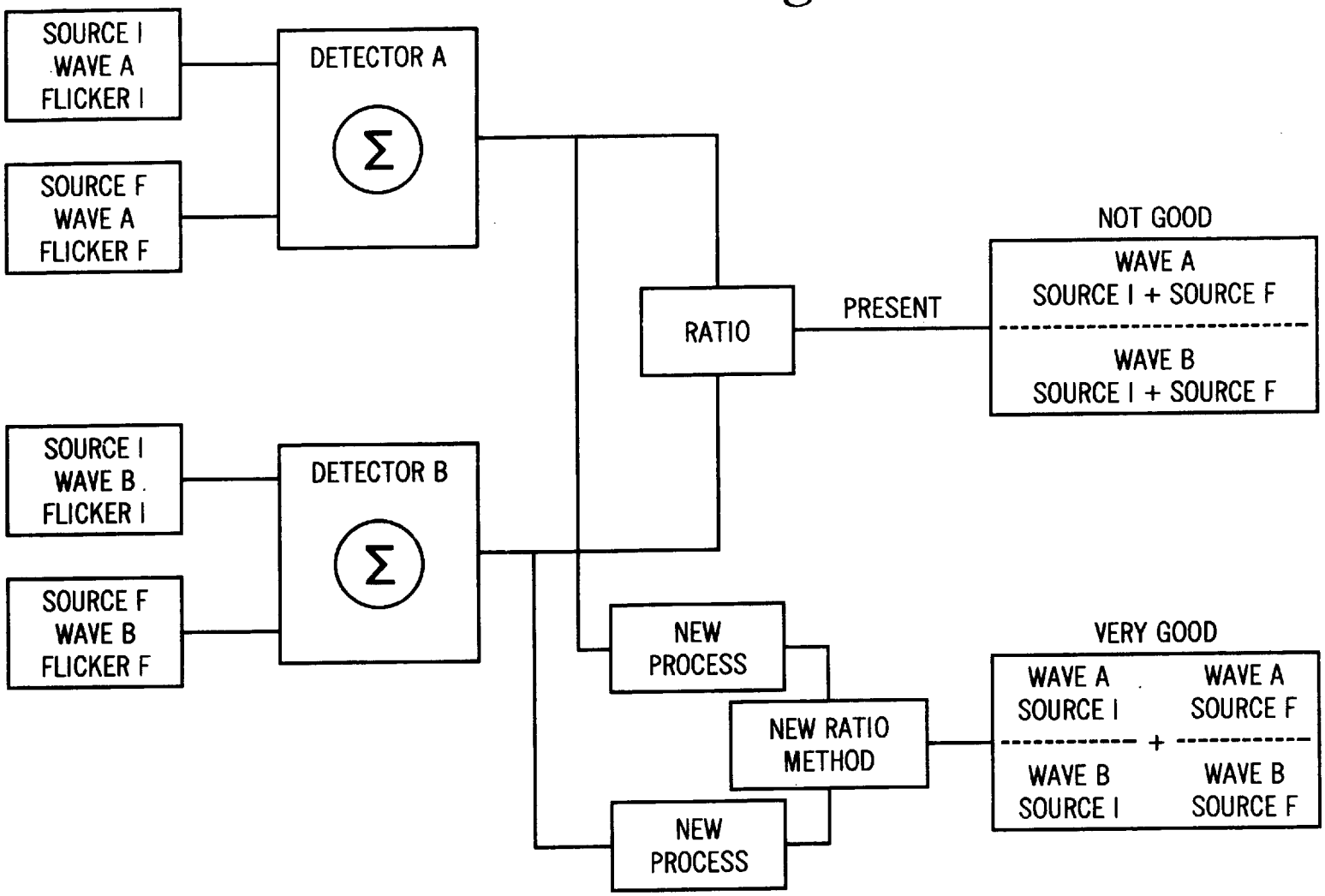
FIG. 3 is a schematic comparing the prior art method with the method of the present invention.

FIG. 3 depicts an abstraction of the preferred embodiment for the purpose of quickly getting an overview of signal flow and to contrast the invention with the present state of the art. Each detector output in the electrical form of a time-varying voltage represents the instantaneous sum of all radiant input sources, thus the reason for the capital sigma in each detector block. FIG. 3 simplifies a vast possibility of inputs to two sources at each of two wavelengths.

Present devices generate a ratio of the sum of all these sources as depicted by the path titled "present." As discussed in the background section, this scenario presents discrimination problems and is not a good alternative. The present invention supplies the tools necessary to decompose the signal in order to arrive at the ratio of each source separately at the expense of new signal processing depicted in FIG. 3.

A fair analogy is to consider broadcast television where many types of information are presented to the transmitter "simultaneously" yet just one electromagnetic band is transmitted. Following reception at the television receiver the composite signal may be decomposed into all the intelligence presented at the transmitter using various demodulation techniques.

The present invention also relates to amplitude-modulated electromagnetic energy and is closely analogous to the AM portion of a television signal if one shrinks each IR wavelength band to an infinitely narrow wavelength. In this manner, the IR band is analogous to a broadcast band "carrier." The point of the analogy is to think in terms of one signal at each wavelength that carries many sources of modulation "simultaneously" which may be demodulated at a receiver.

That is, FIG. 3 shows that a false fire source, such as a chopped black body (e.g. an incandescent bulb behind a rotating fan) has a characteristic "flicker frequency" identified as Flicker 1 (in the example given here, the flicker frequency would be the rpm of the fan times the number of fan blades). A fire source F is also shown as having a characteristic "flicker frequency" identified as Flicker F. Flicker 1 is the same at each of wavelength A and B, and Flicker F is the same at each of wavelength A and B but different from Flicker 1. The essence of the fire detection scheme employed in the present invention is to sample the total detector output at each of two wavelengths in a plurality of narrow "flicker frequency" bandwidths, ratio the amplitude of the signal at each narrow bandwidth at the two wavelengths, and discriminate a fire in the presence of a non-fire radiant source by the presence of a characteristic "fire ratio" in at least one of the narrow bandwidths. As was seen earlier, a flame will have a much higher ratio in the wavelengths 4.5/5.0 microns than a blackbody due to the "peakyness" of the spectral emittance curve for a flame relative to any blackbody. Reliability may be improved and the chance of a false alarm diminished by requiring the "fire ratio" to be present at a number of discrete flicker frequency bandwidths.

Figure 4:
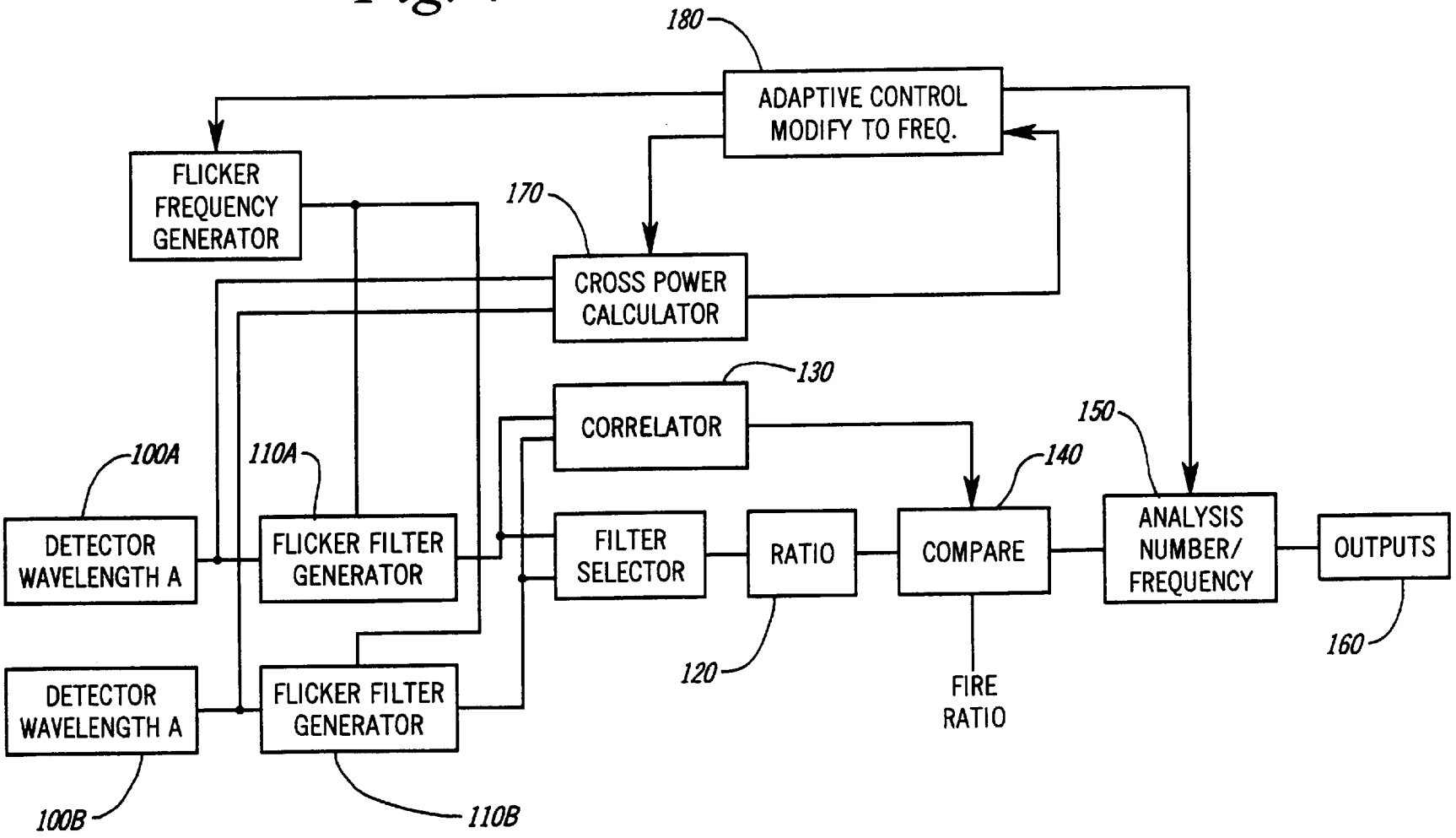
FIG. 4 is a schematic showing the apparatus and method of the present invention.

The new signal processing approach is further abstracted in FIG. 4 and elaborated somewhat. Amplitude-modulated "flicker" outputs from each wavelength detector 100A, 100B are input to identical blocks 110A & 110B. 110A & 110B extract the flicker frequency energy in a specified number of narrow bandwidths. The specific frequencies, number of frequencies, bandwidths, and the particular wavelengths employed are parameters that are chosen to most effectively deal with a particular application in terms of performance and ease of implementation.

The energy in each narrow flicker frequency band from 110A, representing wavelength A, is then ratioed at 120 to the energy in the same narrow flicker frequency band from 110B, representing wavelength B. A correlation parameter (s) 130 is also generated as will be discussed below that will qualify each ratio to prevent false ratios from being processed. Following proper qualification each ratio is compared at 140, one frequency at a time, to a ratio "threshold," or ratio band(s), which generates an appropriate output. In the simplest embodiment, the comparator generates one binary output type for fires and the opposite binary type for nonfires.

The comparator 140 output then feeds an analysis block 150 whose function is to further qualify fire ratios in terms of the number and distribution of fire ratios detected.

When the requirements of the analysis block are satisfied an appropriate output 160 may be signalled. This completes the main signal processing path. The cross power block 170 and the adaptive control block 180 generate outputs that assist in changing the way the system reacts to input stimuli.

The cross power block 170 feeds information about the input signal-to-noise ratio in the entire amplitude frequency domain to the adaptive control block 180. Using this input the adaptive control block 180 sets the bandwidth of the "flicker" filter generator 110A, 110B and/or number of filters to be analyzed 150.

To explain this latter action consider that most fires contain many frequencies in the amplitude domain, thought to be analogous to the visible flicker. Thus, "flicker" is a common term to denote these frequencies. A large "flicker" frequency content is a signature of a fire.

In principle if one could generate a relatively large number of filters, say fifty or more, the entire "flicker" frequency band could be saturated with filters thus eliminating the adaptive control block, or the need to generate a "decision" on the number of filters required. In practice the system hardware complexity could be prohibitive using this approach, or a high number of fixed filters.

Figure 19A:
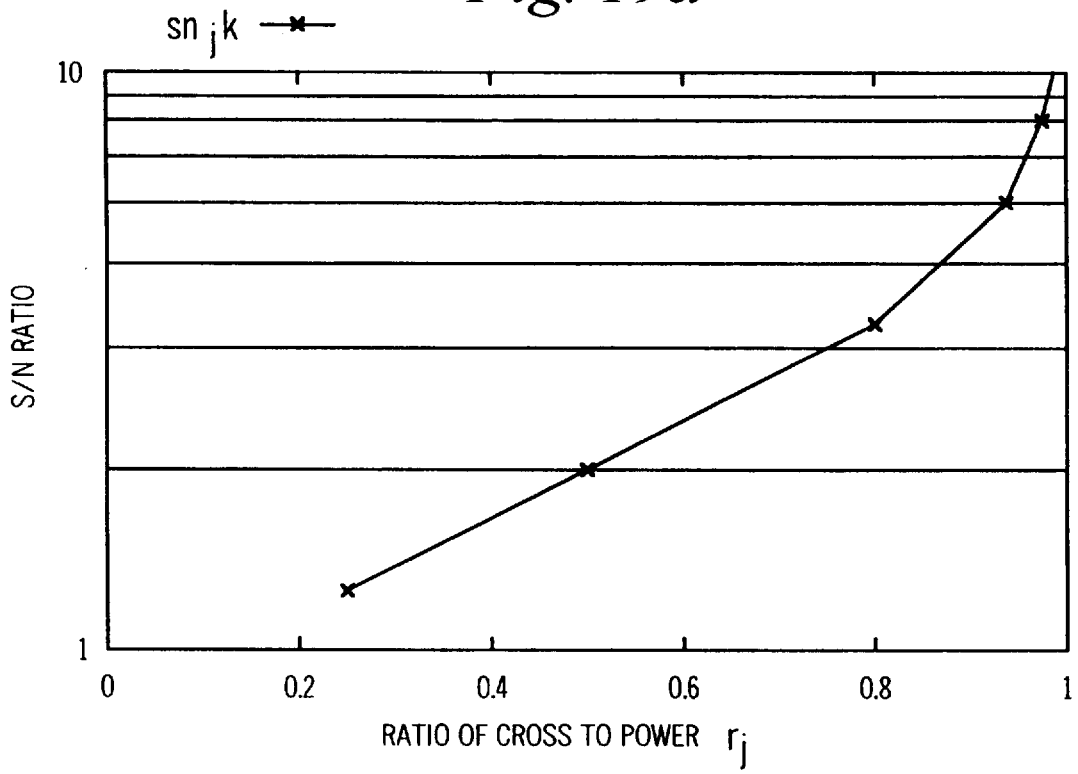
FIG. 19A shows how signal/noise ratio varies with the ratio of cross-power to total power.

To further explain the inputs to the adaptive control block 180 of FIG. 4. refer to FIG. 19*a*. The cross power block 170 takes the output of the detectors 100A, 100B employed and generates the ratio of cross power to total power in these two signals before they are decomposed into flicker frequency content. FIG. 19*a* shows how the output of the cross power block varies as the input signal to noise ratio varies between the detector outputs using empirical data.

The signal in this discussion is that due to radiant input while the noise is that due to electronics noise such as thermal noise.

It is possible to adjust the system parameters in the direction of increasing the signal to noise ratio if the present signal to noise ratio is too low for reliable determination of the presence of a fire.

Figure 19B:
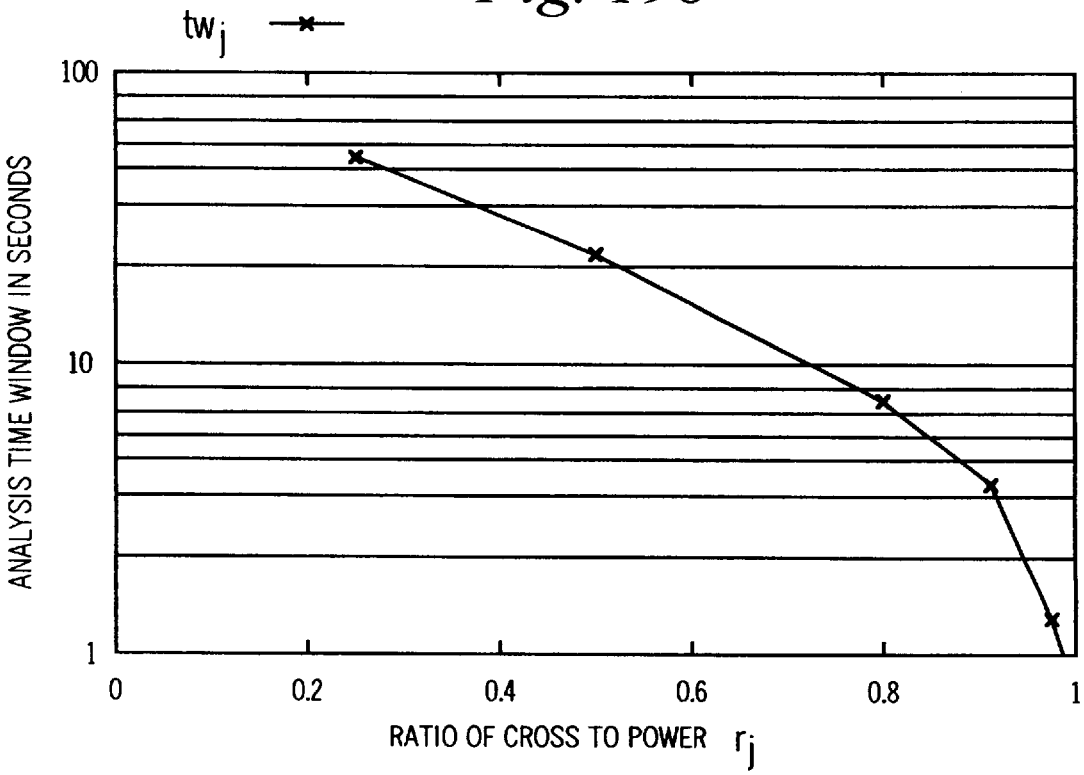
FIG. 19B shows the relationship between the analysis time window and the cross-power ratio to obtain a constant output signal/noise ratio.

FIG. 19*b* shows the relationship between the analysis time window, which is inversely proportional to "flicker" filter bandwidth, and the cross power ratio to attain a constant output signal-to-noise ratio. Thus, if the present cross power ratio is 0.6 and the present analysis time window is less than 10 seconds, the adaptive control block 180 would ideally adjust the time window towards 20 seconds to attain adequate output signal-to-noise ratio.

Figure 19C:
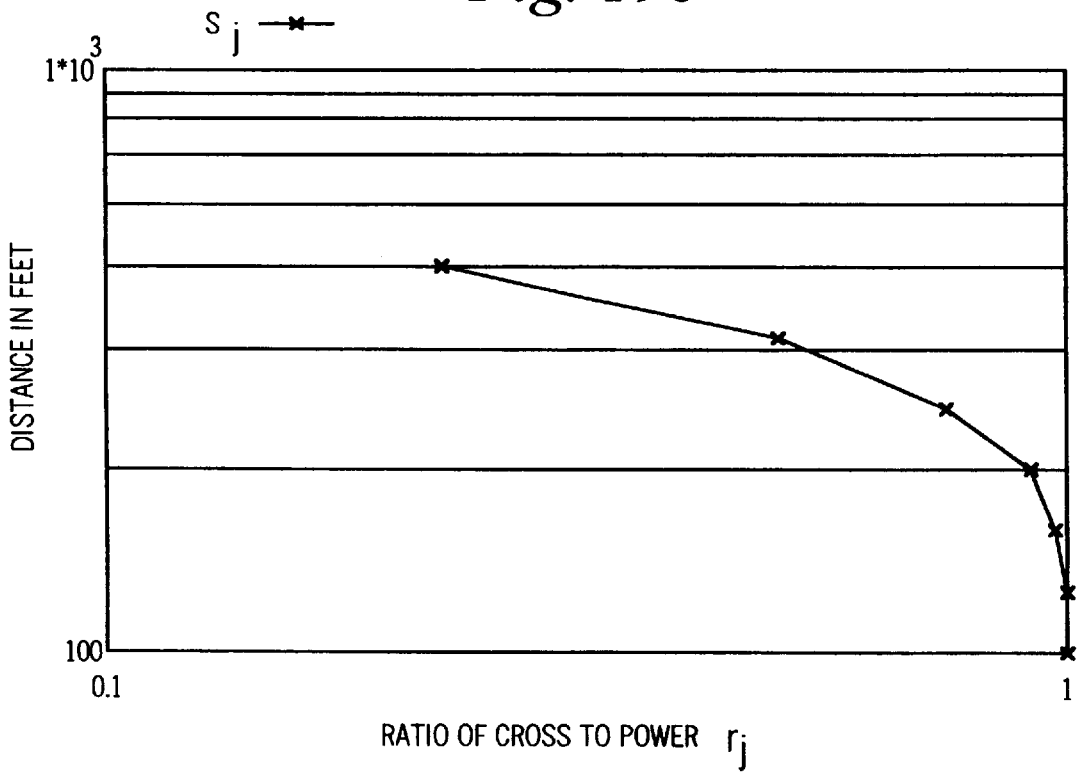
FIG. 19C shows the relationship between distance to the fire and ratio of cross-power to total power.

FIG. 19*c* shows the advantages of using a long time window by showing the relationship between distance and the cross power ratio. As the distance to a given fire size increases, the signal-to-noise ratio decreases in reference to a fixed bandwidth, or time window. If the bandwidth can be reduced, or time window increased, the signal-to-noise ratio can usually be increased, but not always. The cross power ratio will indicate if this is the case by following the relationship to time window.

Each detection system is slightly different in terms of both inherent characteristics and specified performance. Thus, an empirical determination of minimum signal-to-noise ratio is called for. The example system requires a signal-to-noise ratio of six or more before multiple flicker frequency bands are required to substantiate a reliable decision to energize fire outputs. FIG. 19*b* and 19*c* are normalized to the minimum ratio required by the example system, and are therefore unique in terms of actual distance and time.

The way in which the cross power graph can be used for any system is that, for a given time window, if the corresponding cross power ratio is equal to or greater, than the requisite signal-to-noise ratio, a single fire ratio could energize system outputs.

Obviously, the 20 second time window mentioned previously implicates the necessity to control this parameter as most fire output decisions need to be asserted as soon as possible. There is therefore a tradeoff between the number of filters needed with the fire ratio and system response time. That is, if faster system response time is needed, increased discrimination can be achieved by requiring several fire ratios be generated in an analysis time window to activate the system output.

This completes the description of the operation of the adaptive control block 180 and supportive elements.

If the ratio correlation parameter is loosely qualified, spurious fire ratios may tend to be generated at low signal levels. To reinforce a level of discrimination one may then require several fire ratios to be generated.

The analysis block 180 may also generate feedback for an adaptive system that generates only the number of filters with appropriate characteristics for the situation being currently processed.

Figure 5A:
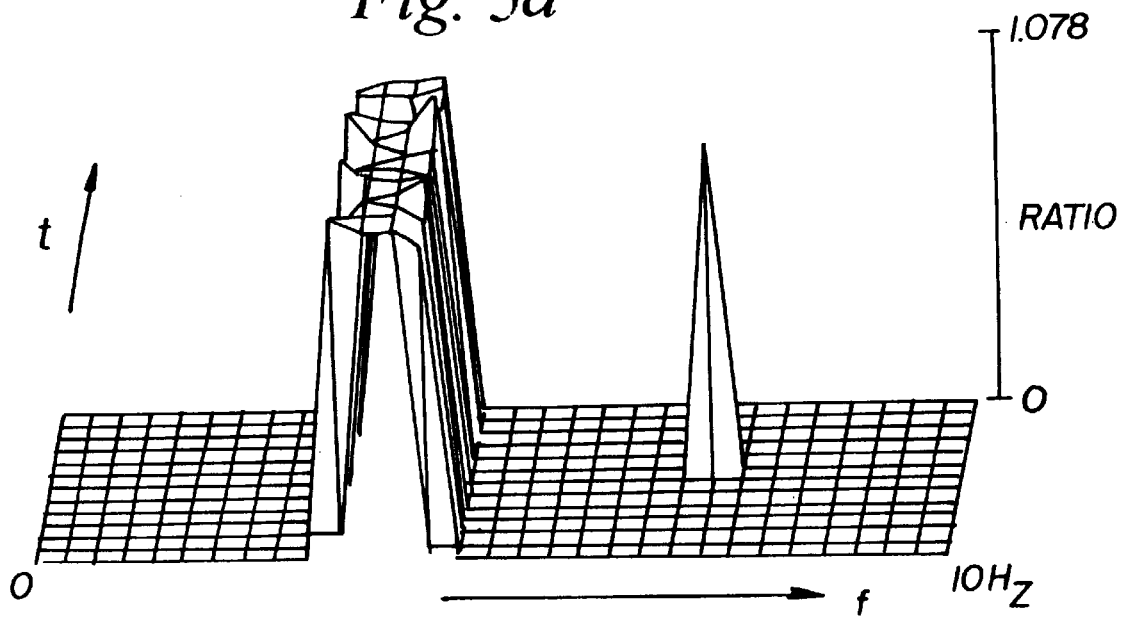
FIGS. 5A and 5B are graphs showing the ratios produced by the present invention at various frequencies during sequential time intervals when the invention is used to analyze a chopped black body at 600 degrees K.

FIGS. 5A, 5B, 6A, 6B and 7A, 7B show the results of analyzing fire and false fire sources with the present invention. FIG. 5A shows a 600 degree K chopped black body with a characteristic flicker frequency of 4 Hz (i.e., a body with a temperature greater than 0° K. whose emission spectrum is periodically blocked, as by a rotating fan blade) as processed by the above-described embodiment. The X axis is frequency from 0 Hz to 10 Hz with frequencies at ⅓ Hz increments. The Y axis (vertical) is in ratio units, or the ratio of two wavelengths at each frequency. The Z axis (into the page) is time in three second increments.

In FIG. 5A, the chopped black body occupies three to four frequency "bins" in the 4 Hz area, because its strength leaks into the filter bandwidths adjacent to 4 Hz. Chopping action produces some harmonic content and so one three second output also contains an output in the 8 Hz area which survived the qualification requirement. Notice that all other frequency "bins" are zero due to the qualification logic process. In other words, there are no extraneous ratios coming through.

Figure 5B:
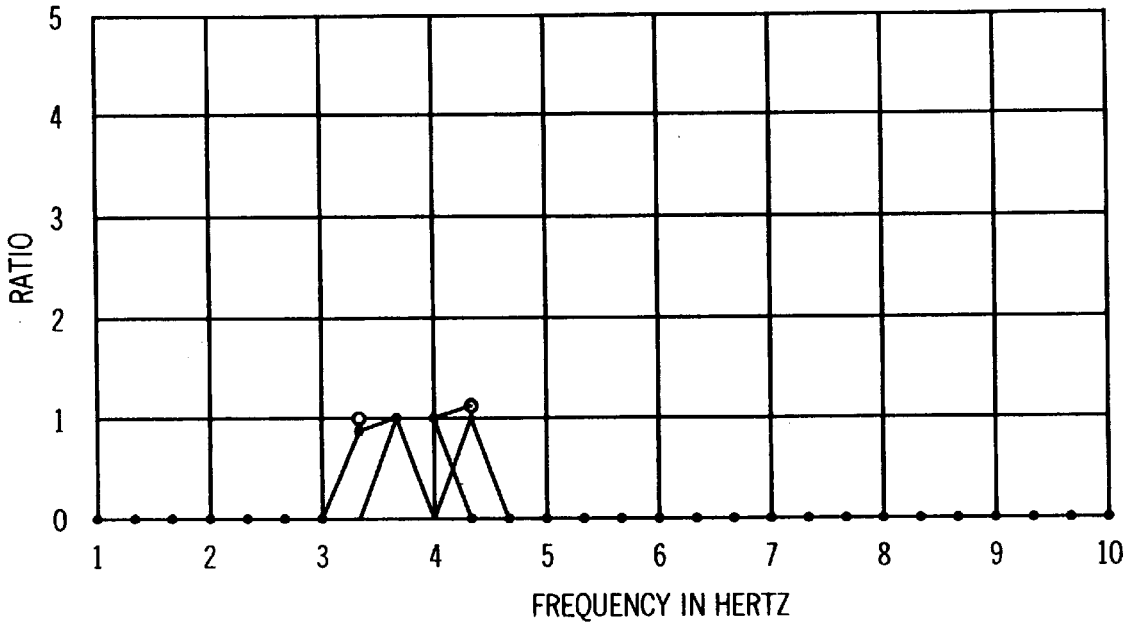

FIG. 5B shows a two-dimensional view of four of the three second outputs. In addition the X and Y axes are labeled so that one can easily identify the frequencies involved.

Figure 1:
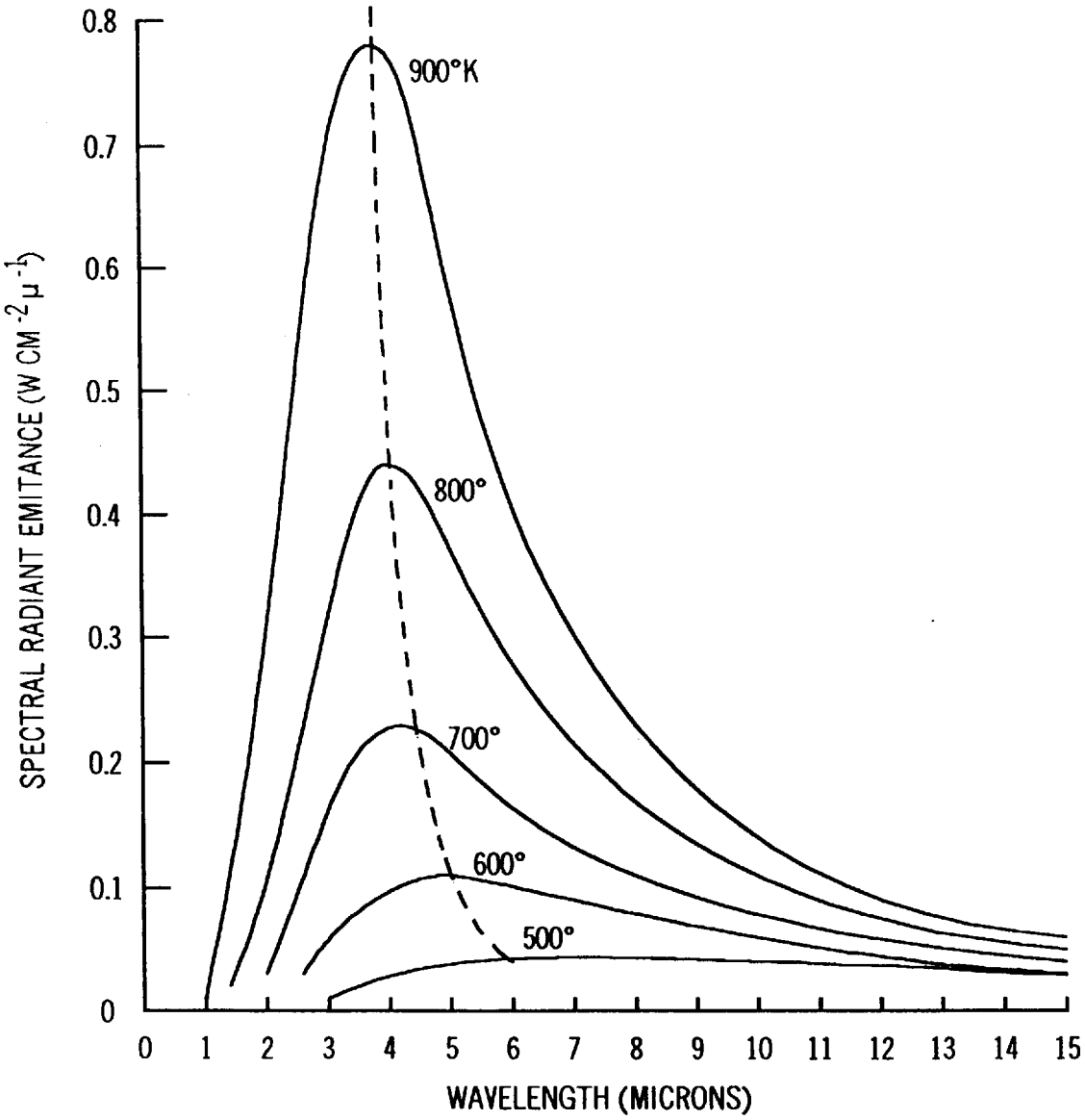
FIG. 1 is a graph showing the spectral radiant emittance vs. wavelength of a blackbody at various temperatures.
Figure 2:
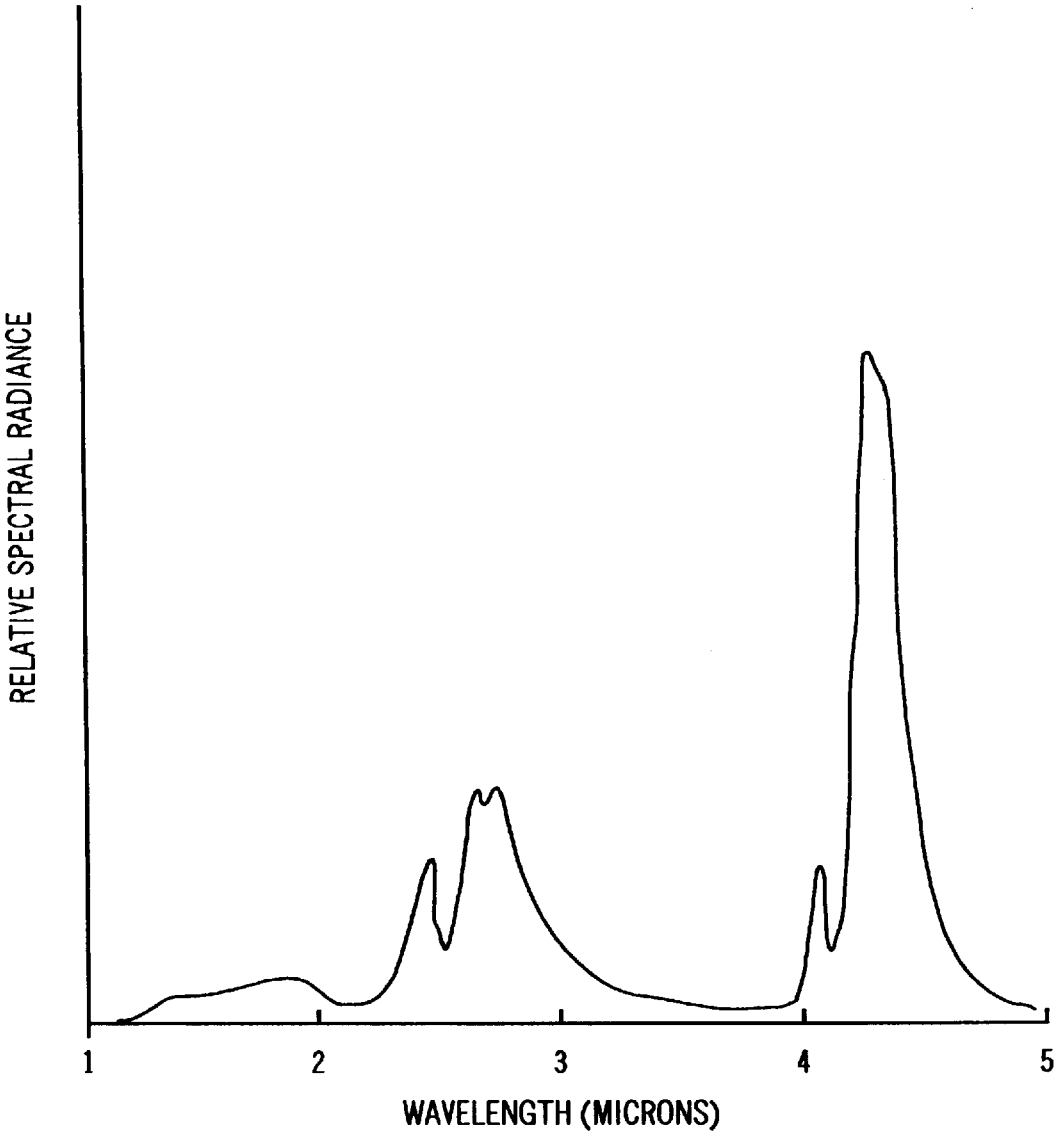
FIG. 2 is a graph showing the relative spectral radiance vs. wavelength of a Bunsen flame.
Figure 6A:
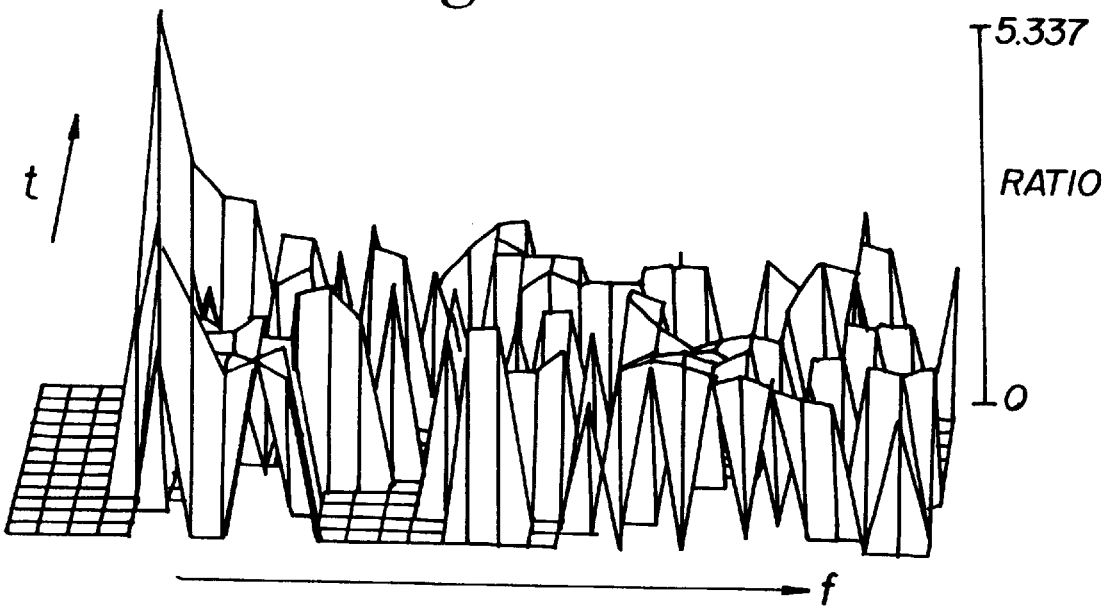
FIGS. 6A and 6B are graphs showing the ratios produced by the present invention at various frequencies during sequential time intervals when the invention is used to analyze an unmixed propane torch with natural convection.
Figure 6B:
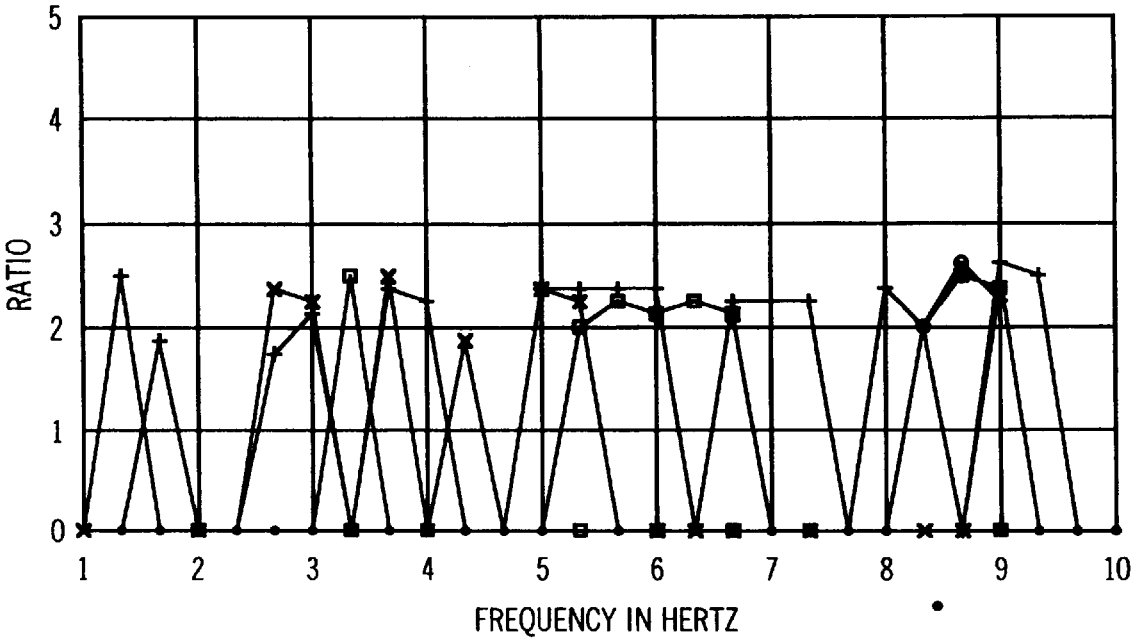

FIG. 6A shows a similar plot of an unmixed propane torch with natural convection. Notice that each three second output contains ratios that survived the qualification process at many different frequencies but not all frequencies. In FIG. 6B, notice that the ratios are markedly different from the chopped false fire source of FIG. 5A. This difference is a consequence of the emissions output of each source and the wavelengths detected for this experiment. That is, the spectral emittance curve (FIG. 2) for the propane torch at the wavelengths selected will produce a characteristic "fire ratio" of about 2 at many different flicker frequencies. Whatever wavelength strategy is used, one must be able to differentiate fire from false fire due to a ratio difference in order for the system to work.

Figure 7A:
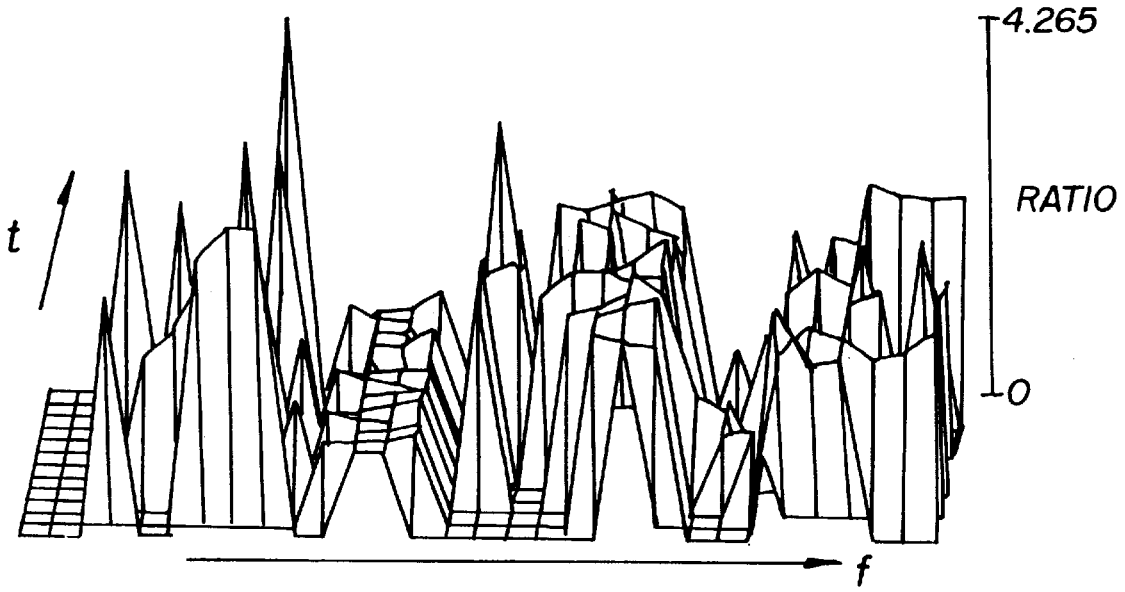
FIGS. 7A and 7B are graphs showing the ratios produced by the present invention at various frequencies during sequential time intervals when the invention is used to analyze an unmixed propane torch with natural convection in the presence of a chopped black body at 600 degrees K.
Figure 7B:
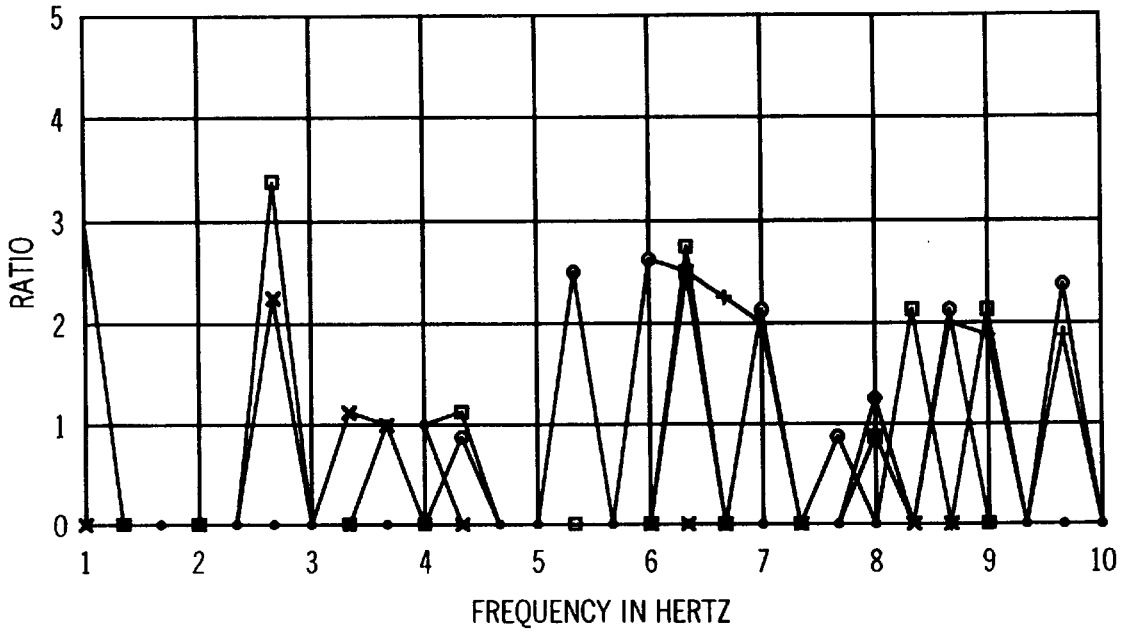

FIGS. 7A and 7B show another similar plot of both the chopped black body and the propane torch. This plot clearly shows that the system can identify both sources simultaneously by demodulating the flicker frequency components. In this experiment, the chopped black body spectral energy was more than 15 times that of the fire with a total energy of more than three times that of the fire.

Because of the high energy level of the black body, the ratio in the four Hertz area still comes through at about one and occasionally at the first harmonic. At other flicker frequencies unoccupied by the black body, the fire ratio of two plus comes through. If one were to ratio the total energy in a wider traditional flicker frequency bandwidth one would have arrived at a ratio of approximately 1.15 which would have failed to detect the fire.

Figure 8A:
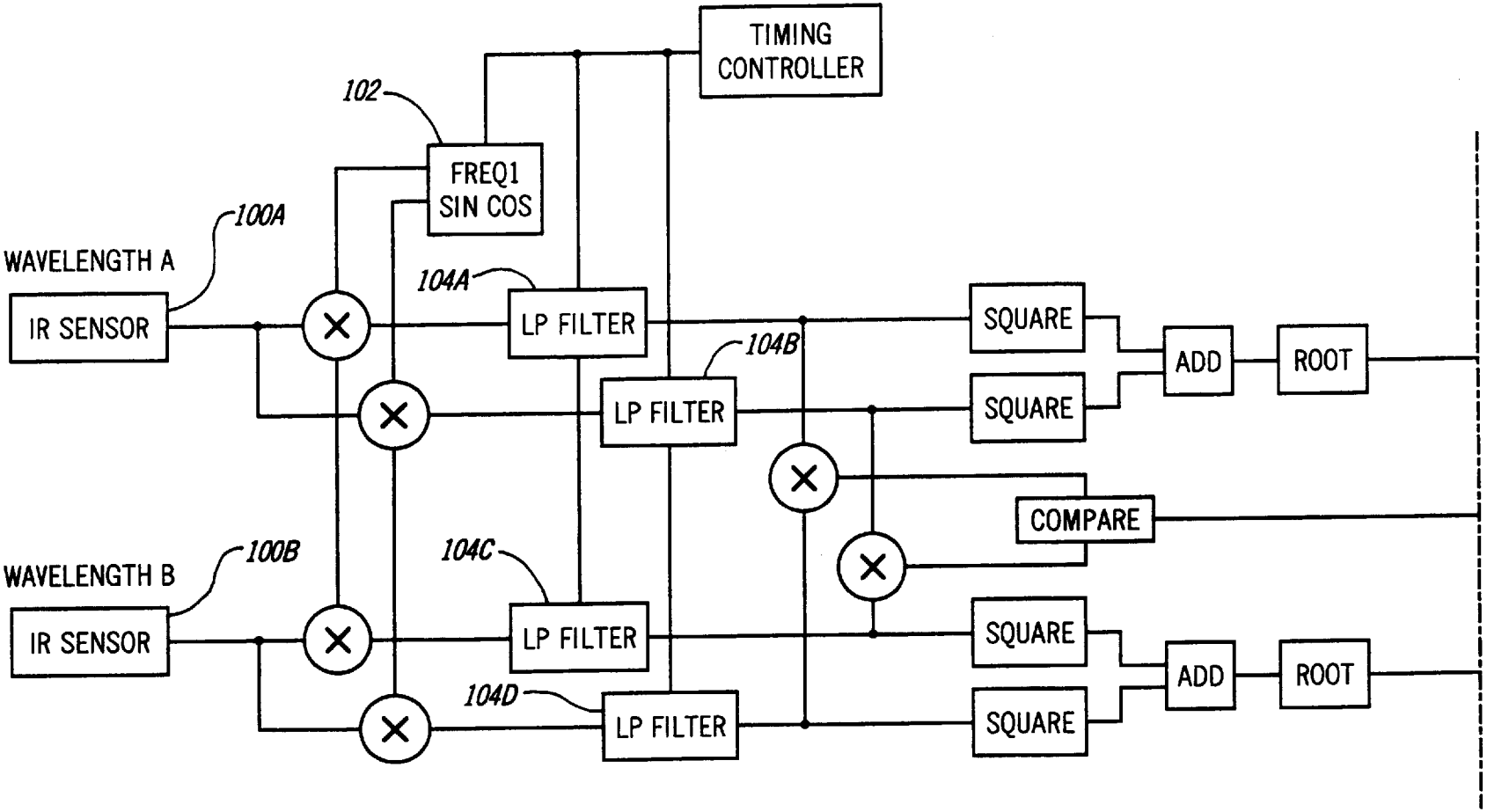
FIG. 8A is a detailed schematic of the present invention using technique A (more difficult).

FIG. 8*a* shows detail of a simplified frequency extractor that computes the energy in each narrow bandwidth for each wavelength and generates a correlation indicator in "real time". Though the detail of 8*a* is a simpler concept than FIG. 8*b*, the preferred embodiment to be explained later, it does generate continuous output at the expense of requiring much more computational horsepower.

FIG. 8*a* shows the total radiant energy signal at each wavelength 100A, 100B being multiplied by an internally generated sinusoid 102 corresponding to each flicker frequency. Thus,

V1+sin(A) Consider this 100A, 100B as the unknown input signal consisting of sinusoid plus some d. c. level. (total radiant energy signal)

V2+sin(B) This is the internal sinusoid 102. (flicker frequency)

Then:

$$(V1 + \sin(A)) \therefore (V2 + \sin(B)) = V1 \cdot V2 + V1 \cdot \sin(B) + V2 \cdot \sin(A) \ldots + \frac{1}{2} \cdot (\cos(A - B) - \cos(A + B)).$$

Make the following substitutions:

$$A=\omega\cdot t+\phi=2\cdot\pi\cdot f1\cdot t+\phi$$

$$B=\omega\cdot t+\theta=2\cdot\pi\cdot f2\cdot t+\theta$$

At each instant of time "t", "A" and "B", the arguments of the above sine functions, produce a radian angle. Along with the time dependent angle is a fixed offset angle (phase). When these substitutions are made you arrive with the following expansion.

$$\cos((2\cdot\pi\cdot f2\cdot t+\phi)-(2\cdot\pi\cdot f2\cdot t+\theta))=\cos(2\cdot\pi\cdot t\cdot(f1-f2)+\phi-\theta)$$

$$\cos((2\cdot\pi\cdot f2\cdot t+\phi)+(2\cdot\pi\cdot f2\cdot t+\theta))=\cos(2\cdot\pi\cdot t\cdot(f1+f2)+\phi+\theta)$$

This results in the final expression.

$$V1 \cdot V2 + V1 \cdot \sin(B) + V2 \cdot \sin(A) + \frac{1}{2}\left[\begin{array}{c}\cos(2 \cdot \pi \cdot t \cdot (f1 - f2) + \phi - \theta) \ldots + \\ \cos(2 \cdot \pi \cdot t \cdot (f1 + f2) + \phi + \theta)\end{array}\right]$$

When the internal sinusoid is V2+cos(B) the resulting expansion is.

$$V1 \cdot V2 + V1 \cdot \cos(B) + V2 \cdot \sin(A) + \frac{1}{2}\left[\begin{array}{c}\sin(2 \cdot \pi \cdot t \cdot (f1 + f2) + \phi + \theta) \ldots + \\ \sin(2 \cdot \pi \cdot t \cdot (f1 - f2) + \phi - \theta\end{array}\right]$$

In each expansion, the DC terms V1·V2 , V1·sin(B), V1·cos(B) and V2·sin(A) are removed by appropriate techniques.

In FIG. 8*a* the product of each input wavelength 10A, 100B and the internally generated sine/cosine expression 102 is low-pass filtered in "real time" at 104A, 104B, 104*c*, 104D. In principle this can be accomplished by a number of continuous time filters of some high order to be equivalent to the embodiment of 8*b* to be explained shortly. Preferably software "IIR" filters would be employed to reduce component count, space, and cost. This removes the terms which contain the sums of the frequencies (f1+f2), leaving the terms containing the difference of the frequencies (f1−f2), which is the desired result.

The approach of FIG. 8*a* requires more than 6 times the number of arithmetic operations just to generate filters equivalent to the embodiment of 8*b*. Also, the approach of FIG. 8*a* is difficult to adjust filter parameters to adapt to changing input. Again the advantage of the "simplified concept" approach is that output is obtained continuously.

Figure 8B:
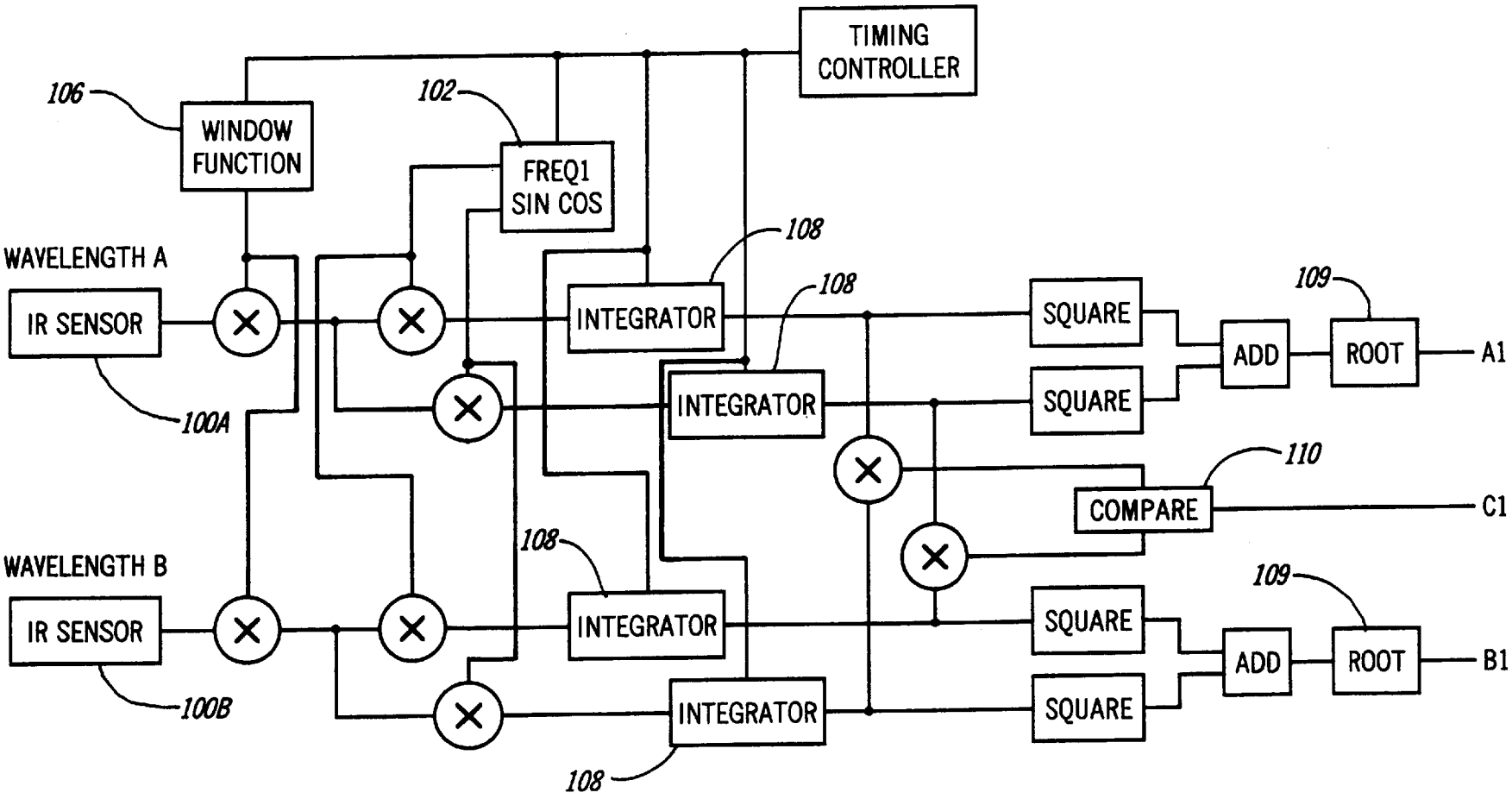
FIG. 8B is technique A using less calculation intense approach.

FIG. 8B represents the essential details of the "frequency extractor" which computes the input modulation energy in one narrow bandwidth for each wavelength and generates a ratio and a correlation indicator. The performance of this section is the most critical element of the detector. When the parameters are properly set, it allows "demodulation" of an input modulation frequency while rejecting other modulations which may also be present.

This rejection characteristic describes the reaction to unwanted signal and is very important when it comes to separating small amplitude fires in the presence of large amplitude false fires. Another useful term is selectivity which describes the "frequency extractor" characteristic to wanted signal.

Selectivity is controlled by the integration time, or time window over which the integrator runs, and by the window function 106. Both of these parameters affect the bandwidth and the selectivity. The integration time affects the half power bandwidth and the window function 106 affects the bandwidth at 1/10000 power bandwidth. Without the window function, the device would not be able to select small fires in the presence of large false fires without impractically long integration times.

Basically, FIG. 8B functions to arrive at an output over a selected time window. Again the output represents the energy content in one of many narrow frequency bandwidths. Each frequency along with the window function also operates over this prescribed time window. While traversing this time window, the incoming signal 100A, 100B must be multiplied by one of the window functions 106 of FIG. 9 and the sine and cosine 102 of each narrow frequency bandwidth.

Figure 9A:
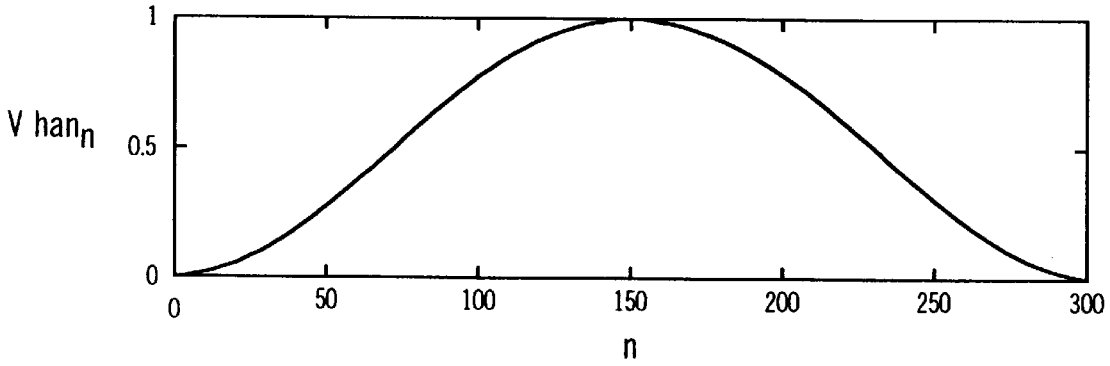
FIGS. 9A, 9B and 9C show the graphs of three window functions utilized in the present invention.
Figure 9B:
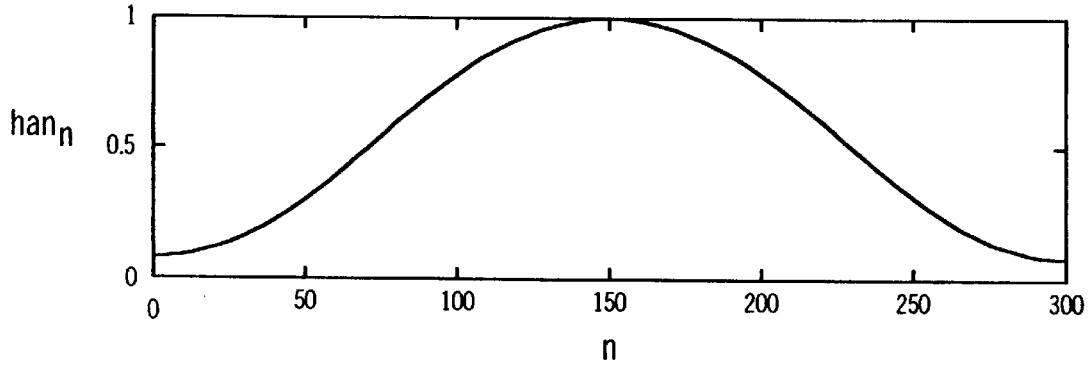
Figure 9C:
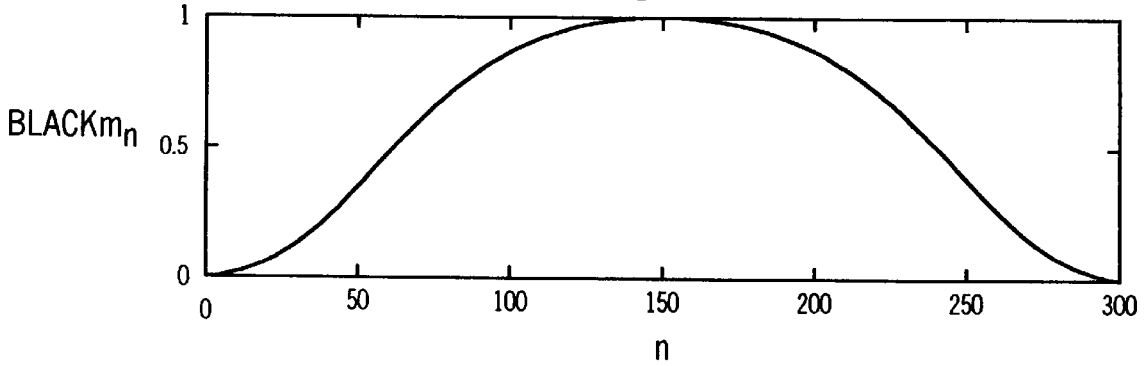

FIG. 9 depicts a number of window functions, but other custom functions are possible. The window functions of FIG. 9 are known as the Blackman, Hamming, and Von Han window functions, designated as blackm, ham, and Vhan, respectively and the corresponding equations are shown in Table 1.

TABLE 1

Parameters and Equations for FIG. 9

| P: = 300 | n: =0 . . . P − 1 | α: = .54 |
|---|---|---|

$$\text{blackm}_n := \left[1 - \left[.42 + .5\cdot\cos 2\cdot\pi\cdot\frac{n}{p} + .08\cdot\cos 4\cdot\pi\cdot\frac{n}{P}\right]\right]$$

$$\text{ham}_n := \left[\alpha - (1 - \alpha)\cdot\cos 2\cdot\pi\cdot\frac{n}{P}\right]$$

$$\text{Vhan}_n := \frac{1}{2}\cdot 1 - \cos 2\cdot\pi\cdot\frac{n}{P}$$

Figure 10A:
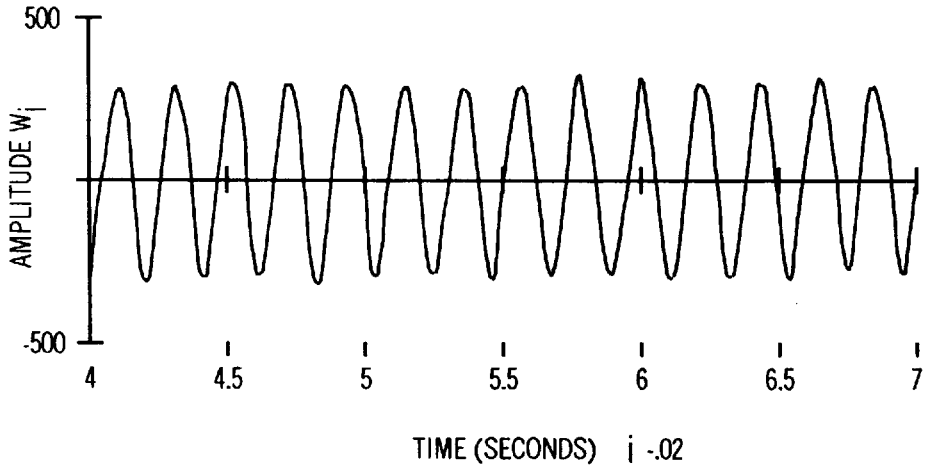
FIGS. 10A and 10B show the result of multiplying a false fire input times a window function.
Figure 10B:
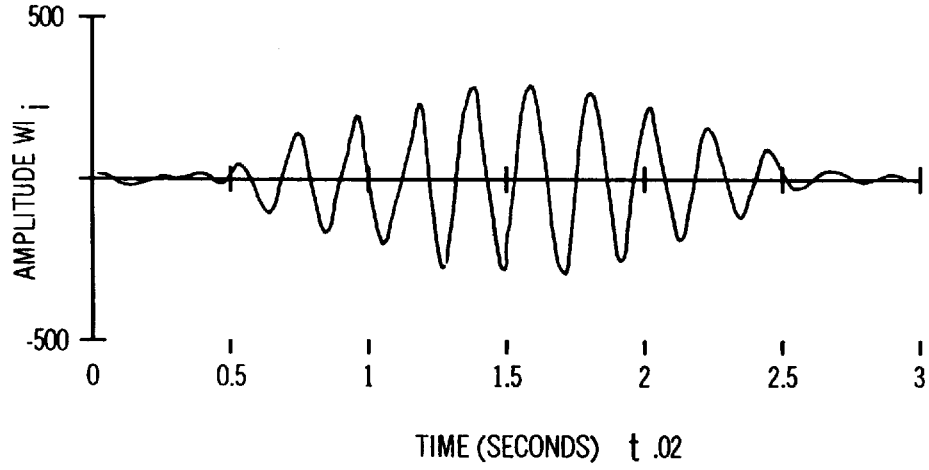
Figure 11A:
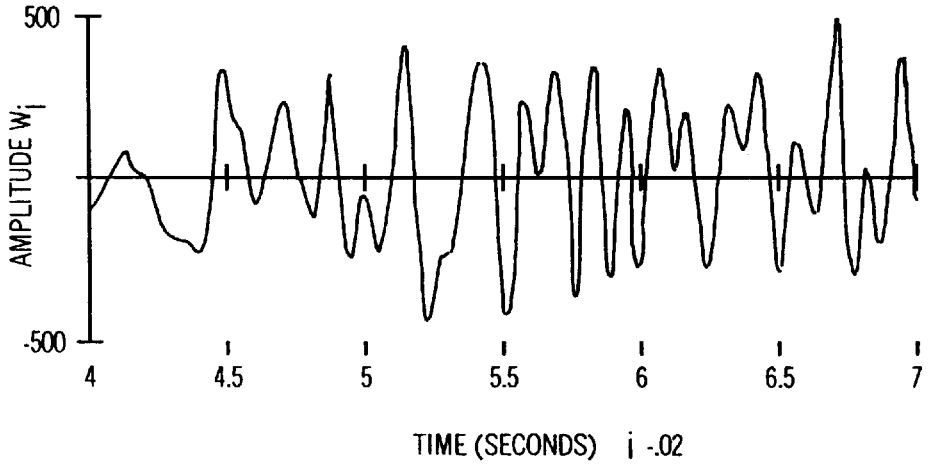
FIGS. 11A and 11B show the result of multiplying an unmixed propane torch input times a window function.
Figure 11B:
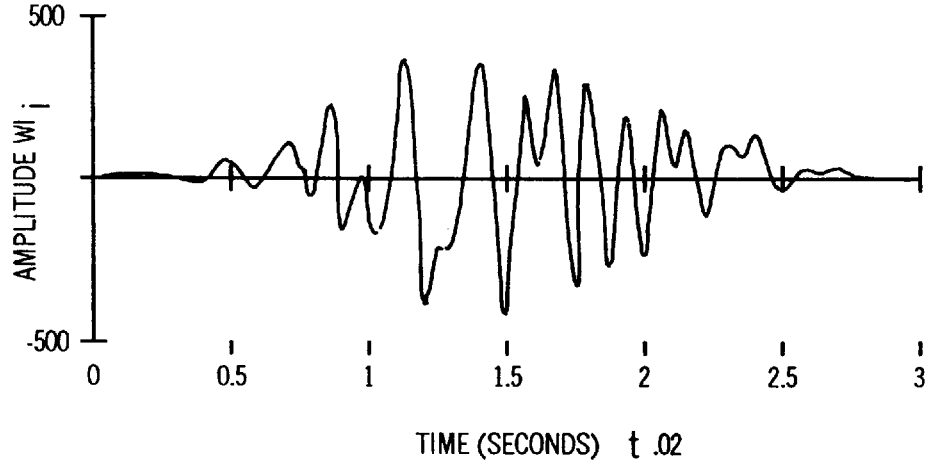

In FIG. 9, the time window is, for example, 3 seconds long with 100 sampling points per second, producing a total of 300 samples (P=300). At each sampling point n, the incoming signal is multiplied by the value of the window function at that point. Following multiplication by one of the window functions, the input signal then actually takes the shape of the window function which starts and ends in some cases at zero. In general, the window function suppresses abrupt changes at the beginning and end of the time window reducing the high frequency content and narrowing the bandwidth of the filter generated. FIG. 10A shows a regular false fire input and FIG. 10B shows the result of multiplying the input by a window function. FIG. 11A shows a propane input and FIG. 11B shows the result of multiplying by a window function.

Figure 12:
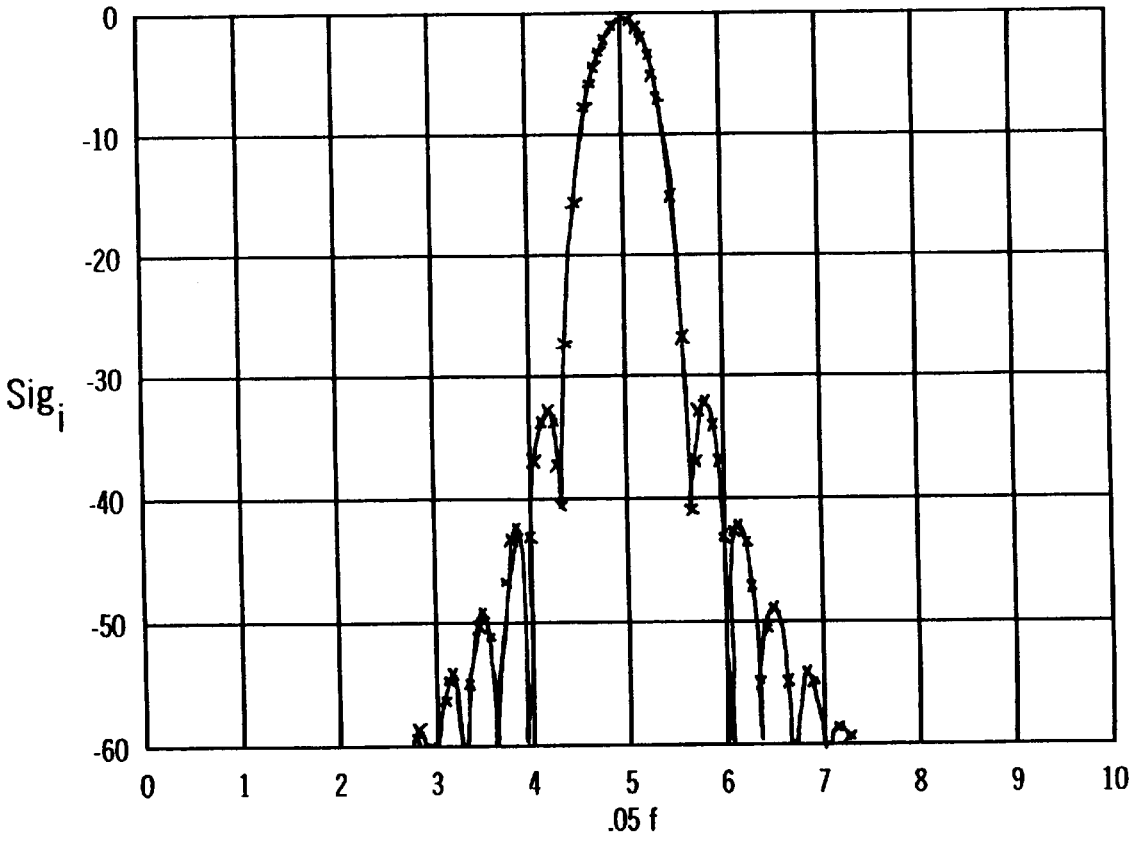
FIG. 12 shows the selectivity of the invention around 5 Hz using a Von Han window function.
Figure 13:
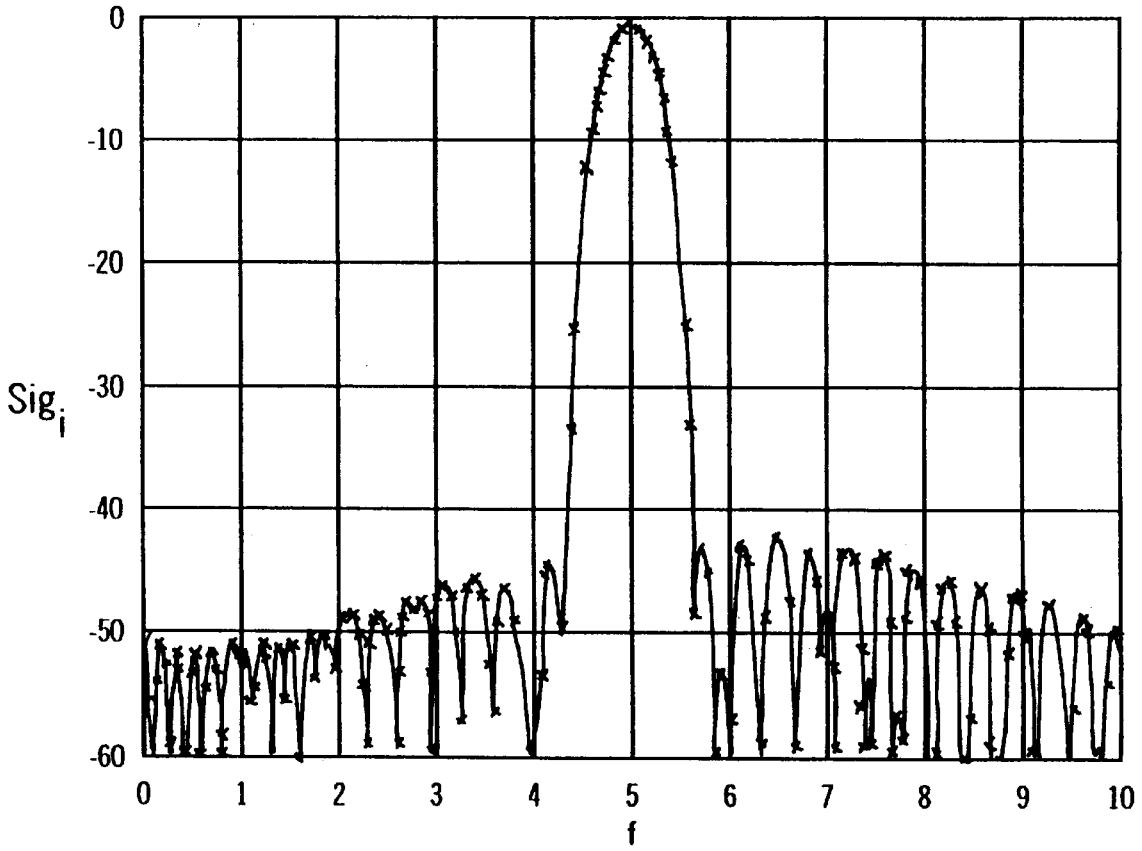
FIG. 13 shows the selectivity of the invention around 5 Hz using a Hamming window function.
Figure 14:
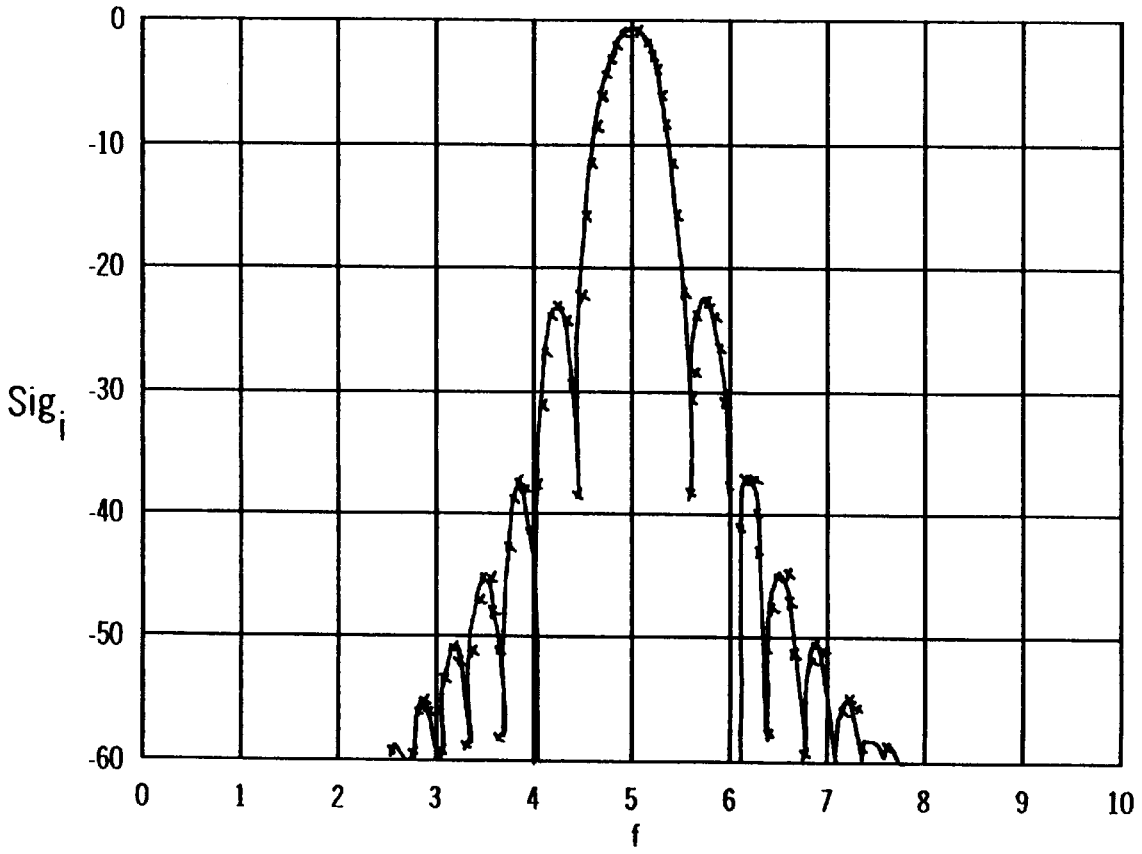
FIG. 14 shows the selectivity of the invention around 5 Hz using a Blackman window function.

FIGS. 12, 13, and 14 show the selectivity of each window function in the frequency domain when the integration time or time window is three seconds long. The parameters and equations used in FIGS. 12, 13 and 14 are shown in Table 2.

TABLE 2

Parameters and Equations Used in FIGS. 12, 13 and 14

| | | |
|---|---|---|
| $f := 1 \ldots 200$ | $f := 0 \ldots 1499$ | $\alpha := .54$ |
| $x_f := \frac{100}{.05 \cdot f}$ | $P := 300$ | $n := 0 \ldots P-1$ |

FIG. 12

$$\mathrm{blackm}_n := \left[1 - \left[.42 + \left(.5 \cdot \cos\left(2 \cdot \pi \cdot \frac{n}{P}\right) + .08 \cdot \cos\left(4 \cdot \pi \cdot \frac{n}{P}\right)\right)\right]\right]$$

FIG. 13

$$\mathrm{ham}_n := \left[\alpha - (1-\alpha) \cdot \cos\left(2 \cdot \pi \cdot \frac{n}{P}\right)\right]$$

FIG. 14

$$\mathrm{Vhan}_n := \frac{1}{2} \cdot \left(1 - \cos\left(2 \cdot \pi \cdot \frac{n}{P}\right)\right)$$

$$\mathrm{test}_{n,f} := \sin\left(2 \cdot \pi \cdot \frac{n}{x_f}\right) \cdot (\mathrm{Vhan}_n)\mathrm{or}(\mathrm{ham}_n)\mathrm{or}(\mathrm{blackm}_n)$$

$$\mathrm{Ft}_f := \frac{1}{P} \cdot \sum_{n=0}^{P-1} \mathrm{test}_{n,f} \cdot e^{-j \cdot 2 \cdot \pi \cdot 15 \cdot \frac{n}{P}}$$

$$\mathrm{Test}_f := |\mathrm{Ft}_F|$$

$$\mathrm{Sig}_f := 20 \cdot \log\left(\frac{\mathrm{Test}_f}{\max(\mathrm{Test})}\right)$$

There are some tradeoffs to be made in consideration of absolute rejection. For most situations, window function FIG. 9 middle resulting in the selectivity of FIG. 13 works well; but the absolute rejection of FIG. 9 top resulting in the selectivity of FIG. 12 may be required in some instances. An adaptive system would ideally have several window functions available.

As shown in FIG. 8B, this product (input signal times window function) is then multiplied by a sine/cosine function 102 of each frequency for each wavelength to extract the input energy at a particular frequency, as will be discussed below. This second product is then integrated 108 throughout the time window prior to the arithmetic operation following the integrator. Sine/cosine functions may start anywhere in the cycle but must traverse an integer number of cycles only throughout the time window. This requirement sets the relationship between the time window and the possible frequencies which may be demodulated.

In other words, if the time window were four seconds long then it would be possible to extract the energy in narrow frequency bandwidths at 0.25 Hz increments. Thus 2, 2.5, 4.25, and 5.75 Hz center frequencies are all possible when using a four second time window. The frequency increments possible are the reciprocal of the time window.

Figure 15A:
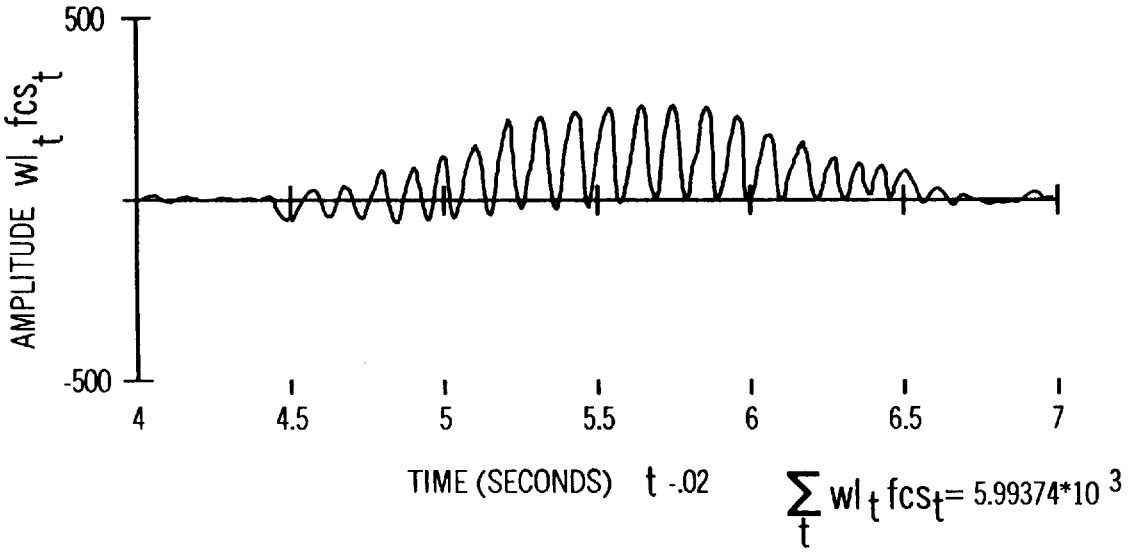
FIG. 15A shows the amplitude of a false fire input multiplied by a window function and a sine/cosine function at 4.67 Hz versus time and the result of integrating this amplitude over time.
Figure 15B:
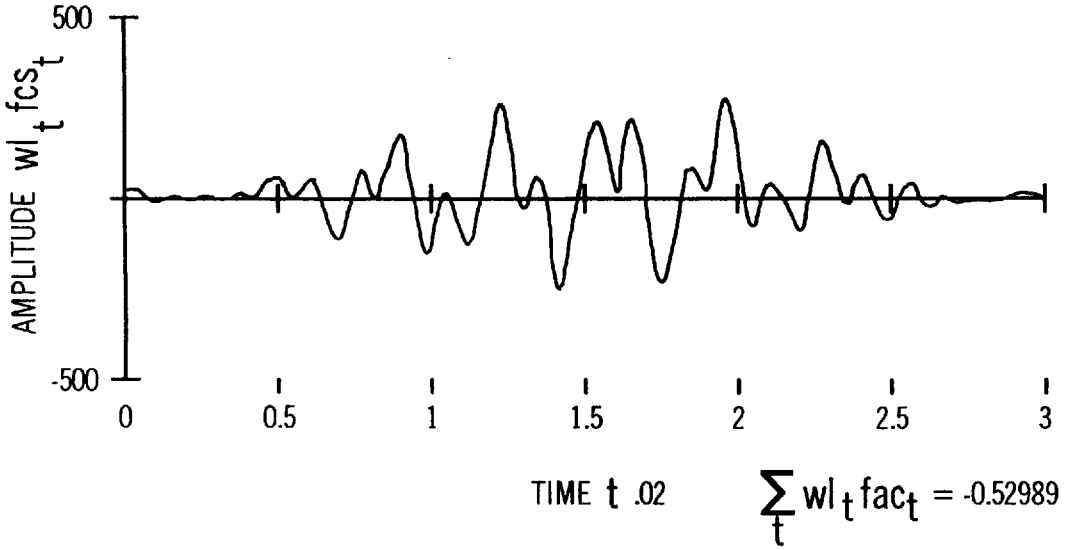
FIG. 15B shows the amplitude of a false fire input multiplied by a window function and a sine/cosine function at 3 Hz versus time and the result of integrating this amplitude over time.

FIG. 15A shows the result of integrating the product of false fire input, window function, and sine/cosine function at 4.67 Hz. FIG. 15B shows the same result with the frequency at 3 Hz. As can be seen, the false fire input has a very large integrated product (approximately 6,000) at the regular flicker frequency of 4.67 Hz, but a very small integrated product (approximately 0.53) at 3 Hz. This is consistent with FIG. 5B.

Figure 16A:
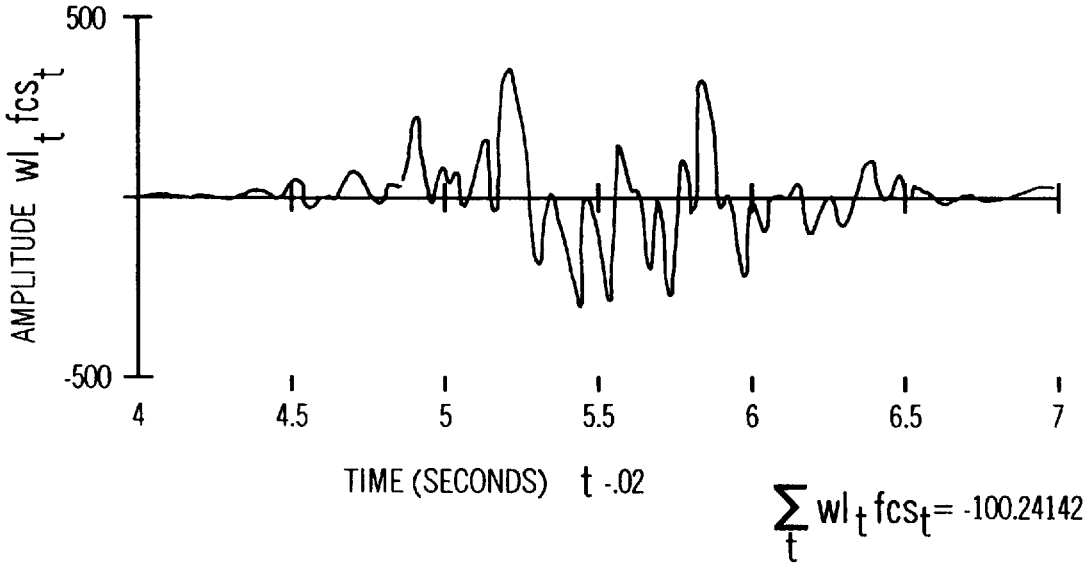
FIG. 16A shows the amplitude of a propane torch input multiplied by a window function and a sine/cosine function at 4.67 Hz versus time and the result of integrating this amplitude over time.
Figure 16B:
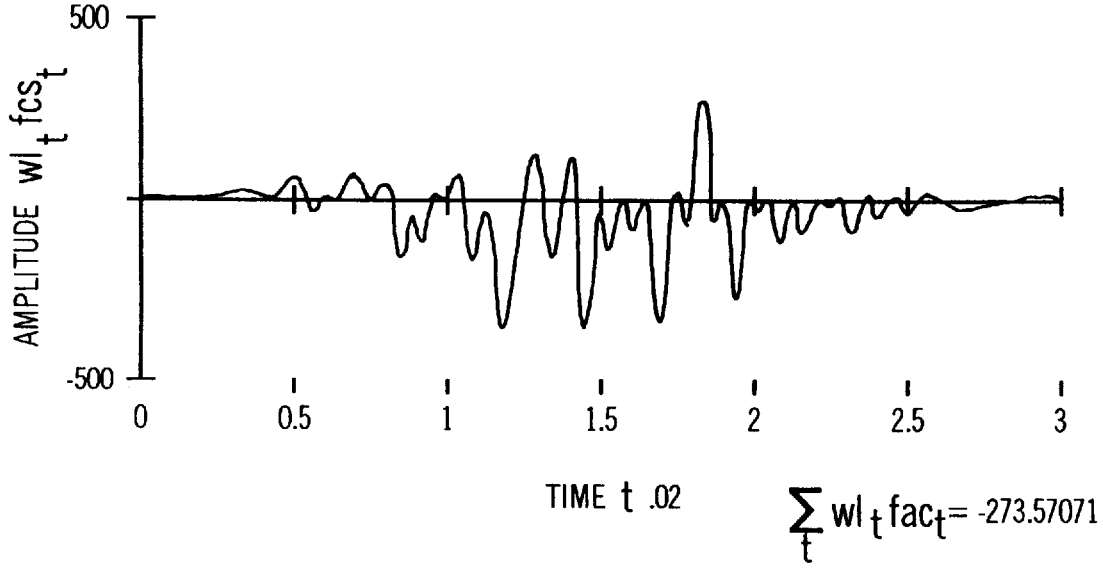
FIG. 16B shows the amplitude of a propane torch input multiplied by a window function and a sine/cosine function at 4 Hz versus time and the result of integrating this amplitude over time.

FIG. 16A shows the result of integrating the product of propane torch input, window function, and sine/cosine function at 4.67 Hz. FIG. 16B shows the same result at 4 Hz. Unlike the false fire input, the propane input generates significant integrated products at two different frequencies (absolute values of 274 and 100 at 4.67 Hz and 4 Hz, respectively). Ratioing these two values produces a characteristic "fire ratio" of 2.74.

Thus, even though the absolute magnitude of the false fire input is very high (6,000) at the false fire flicker frequencies (4.67 Hz), it will be possible to distinguish this from the propane input; because the absolute magnitude of the false fire input is very low (0.53) at frequencies slightly off the false fire flicker frequency.

The last integral 108 in the time window is then applied to the arithmetic operation specified in FIG. 8B ending in the root function 109. The value of the root at this time represents the energy in a specified narrow band present in the applied signal at a wavelength. That is, $\sqrt{(\sin^2+\cos^2)}$ in a vector whose magnitude represents this energy.

Before being ratioed, comparing (110) the sine/cosine cross products as indicated in FIG. 8B correlates the ratio of the two wavelengths. If the products are exactly equal, then the ratio can be taken in confidence (i.e., the two signals are in phase). If the products differ by up to 10 percent, then the ratio is only approximate; and if the products differ by much more than 10 percent, then the ratio should be classified as noisy and false.

Comparing the cross products in this manner is effectively comparing the angle of the two vectors just processed but eliminates generating an inverse tangent function or resorting to look-up tables or other possibly more complicated operations. In either case it should be considered an equivalent operation.

Figure 17:
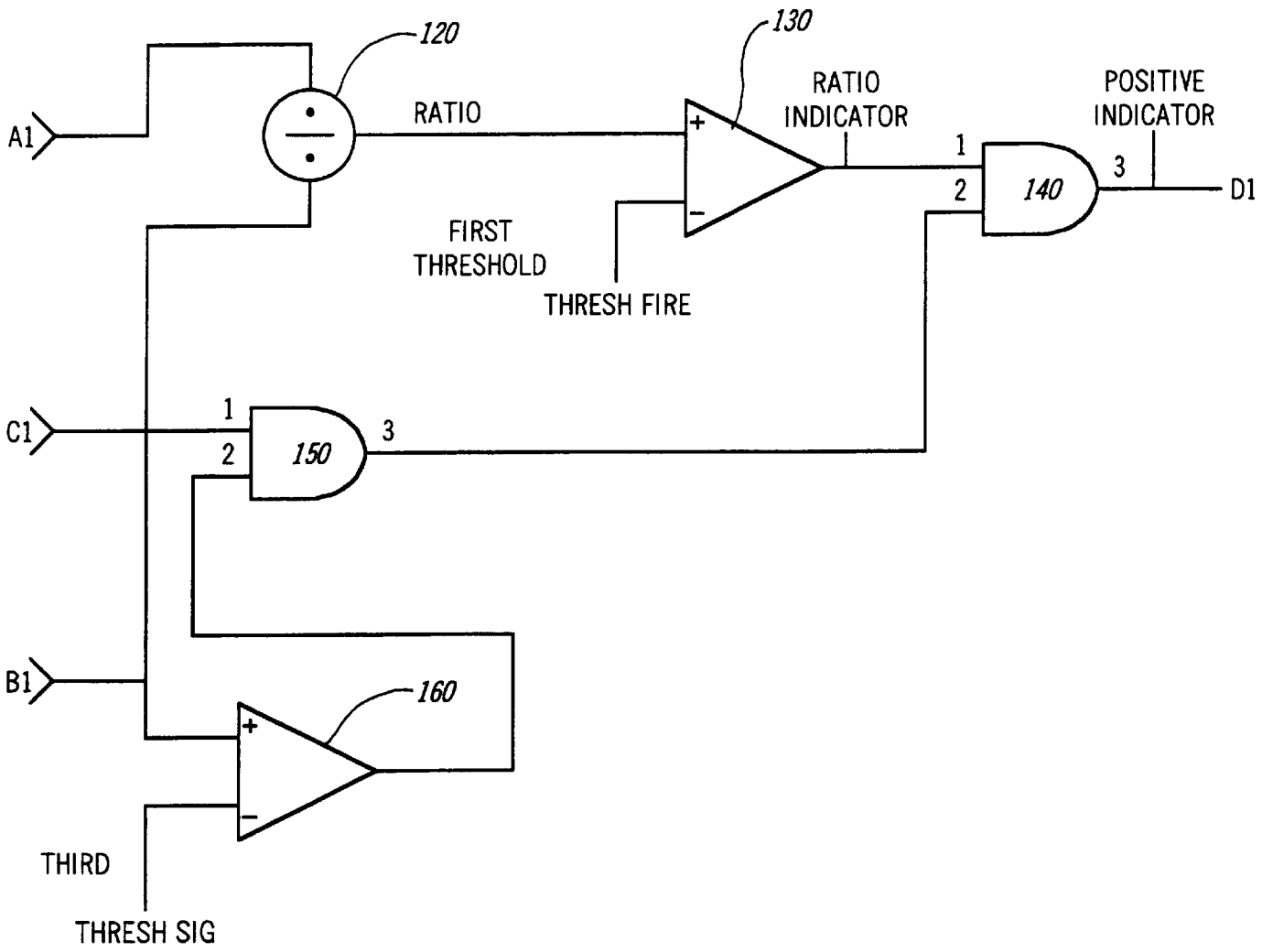
FIG. 17 is a schematic showing inputs from the outputs of FIG. 8 and processing the ratios and correlation indicator.

The outputs of FIG. 8B are then applied to the operations of FIG. 17. "A" and "B" are the outputs of the root operation and "C" is the correlation qualifier. Thus, the outputs A and B are ratioed 120 and compared 130 to the threshold ratio for fire and the result applied to AND gate 140. The correlation qualifier C then passes to gate 150. Since "B" forms the denominator, care should be taken when the denominator is small as the quotient can quickly become unbounded. This is accomplished by qualifying the denominator in terms of level as shown at comparator 160. This operation is recommended but may be omitted.

Figure 18:
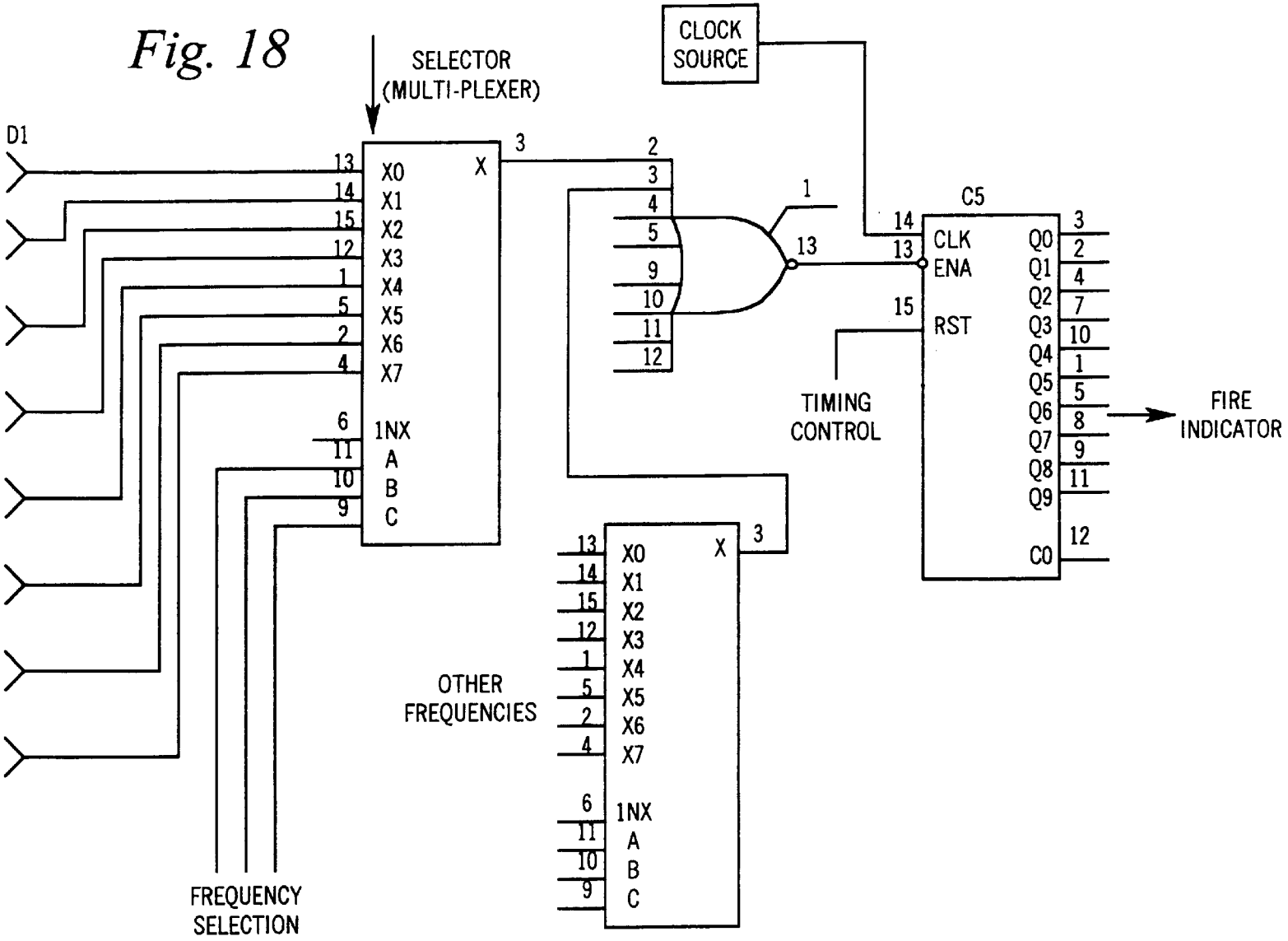
FIG. 18 is a schematic showing inputs from the output of FIG. 17 and generation of a fire indicator.

140 output D1 will then be a "1" if the ratio of the energy in a narrow flicker bandwidth is equal to or greater than the specified ratio for a fire and the output of gate 150 is a binary 1. This output is then passed to FIG. 18 which accepts similar outputs from a number of circuits similar to FIG. 17. FIG. 18 depicts a serial selection scheme where the number of "1" levels are essentially counted by counter C5.

In the simplest embodiment, the appropriate counter output sets the alarm for detecting a fire.

The details of the frequency extractor will now be discussed.

The input to each of the wavelength detectors 100A, 100B in FIG. 8B is an infrared signal containing energy from both fire sources and false fire sources. It is assumed that both the fire sources and the false fire sources flicker at frequencies in the range of 0 to 10 Hz. That is, a false fire source such as a rotating fan blade is assumed to produce a flicker frequency in this range, and it is well known that fires have flicker frequencies in this range.

It is further assumed that the total input to each detector 100A, 100B is a complex periodic signal which can be represented as the sum of many different sinusoids of various frequencies and phases. Such a complex signal can be resolved into sums of weighted and shifted sinusoids using Fourier analysis. In particular, the Fourier series is a mathematical technique for determining the relative strengths and phasing of the sinusoidal components in any particular periodic signal.

The Fourier series may be represented in its trigonometric form as follows:

$$x(t) = \frac{a_0}{2} + \Sigma(a_n\cos(n\overline{\omega}_0 t) + (b_n\sin(n\overline{\omega}_0 t))$$

with n=1 to ∞.

The discrete Fourier transform may be represented as follows:

$$x(F) = \sum_{n=0}^{N-1} x(n)e^{-j\Pi nFT} \quad n = 0, 1 \ldots N-1$$

where F is the frequency in Hertz, and T is the time interval in seconds $$T = \frac{1}{N} = \sum_{n=0}^{N-1} x(n)(\cos(2\Pi nFT) + j\sin(2\Pi nFT))$$

FIGS. 12, 13, and 14 show the application of the various window functions and discrete Fourier transform to produce a filter centered on a flicker frequency of 5 Hz.

In Table 2, "f" and "n" are vectors that take on a range of values as specified in each calculation. "P" and α are constants and always have the assigned values of 300 and 0.54.

"P" is intended to be the total number of points in the analysis time window. Here, P represents a time window that is 3 seconds long with 300 distinct points. Thus 100 points per second are analyzed.

The lines black(), ham(), and Vhan() are the three window functions discussed earlier. The above three functions have 300 distinct values corresponding to the 300 values of n.

$x_f$ is also a function that is used to generate a "signal", which can be thought of as being a signal at a particular wavelength, whose frequency varies over a range of values of the vector f.

The test function is this "signal." The frequency of the test vector takes on as many values as the f vector (200). At each frequency test has a number of points n. In this manner the test function takes on as many values as the product of the n and f vectors or 60,000 points. Thus, the test function is analogous to the output signal of each detector 100A, 100B and is composed of multiple sinusoids of varying frequency $1/x_f$ and sampled at n points in the time interval. Also, at each frequency of the test function, each point gets multiplied by the specified window function.

All of the notation to this point is directed to the "creation" of the test function. Again this function can be thought of as being one of the "signals" at a particular wavelength, i.e., the output of one of the wavelength detectors 100A, 100B in FIG. 8B. Because this test function now has 200 different frequencies it can be used to see (calculate) specifically what the selectivity of the filter is which will be generated in the next step.

At each frequency of the input "signal" the calculation (to follow) is performed, which results in a magnitude (number) for each frequency. This magnitude indicates how much of the input "signal" gets through the filter. A magnitude close to one (0 in the log domain) indicates the signal, whose magnitude in the log domain was not reduced or changed. Magnitudes in the negative direction indicate smaller values and that the signal was reduced (filtered) or changed in value.

The graphs in FIGS. 12, 13, and 14 are then simply plots of those values.

The value $Ft_f$ is calculated as follows for a frequency of 5 Hz:

$$Ft_f = 1/P\ \Sigma\ \text{test}_{n,f}e^{-j2\Pi 15n/P} \quad n = 0, 1 \ldots P-1$$

or $$Ft_f = \frac{1}{P}\ \Sigma\ \text{test}\left(\cos\left(2\Pi 15\frac{n}{P}\right) - j\sin\left(2\Pi 15\frac{n}{P}\right)\right)$$

As described previously, the test function is simply a number of sine waves. However, the complex exponential is a pair of sinusoids at just one frequency, 5 Hz. The number 15 in the exponent is the number of rotations of 2Π in angle throughout the 3 second 300 point analysis window. 15 per 3 second window is then equivalent to 5 rotations per second or 5 Hz.

In the exponent the n/P multiplier can be thought of as a fraction that starts at zero and increases to nearly one at the end of the time window, the last value of n. In this manner the 5 Hz sinusoid is created (sine cosine pair).

The product of the test function (input signal) and the 5 Hz sine cosine pair are summed over the range of values of n to arrive at a pair of numbers for that particular test function frequency. The pair of numbers represent the real and imaginary parts. The imaginary operator j is used to designate the product of the sine as being the imaginary part. Using the absolute value of the real and imaginary parts (or the square root of the sums of the squares) as shown in FIG. 8B gives the true magnitude of the "filtered" test function (input signal). As can be seen in FIGS. 12, 13, and 14, the result is a filter which has high selectivity centered around the narrow frequency bandwidth employed in each integration. Consequently, frequencies in the input signal from the detectors 100A, 100B outside this narrow bandwidth will be filtered out. The true magnitude of the filtered signal for each of the detectors 100A, 100B is then ratioed as shown in FIG. 17 and a ratio indicator is generated.

As shown in FIG. 8B, a correlation indicator $C_1$ is also generated. Implied in the vector sum of each output is an angle comparison of the integrated angle over the time window which gives a measure of the likeness or correlation from one wavelength to the other wavelength. The angle is represented by the relationship of the sine and cosine of each wavelength, i.e.:

$$\Theta = \frac{\sin}{\cos}$$

Thus to compare the angles of each wavelength one must set the ratio of the sin/cos of wavelength a equal to sin/cos of wavelength b:

$$\frac{\sin(a)}{\cos(a)} = \frac{\sin(b)}{\cos(b)}$$

or when $$\sin(a)\cos(b) = \cos(a)\sin(b)$$

the result of the comparator 110 will be true. This means taking the cross products of the real and imaginary parts of the discrete Fourier transforms. In FIG. 17, a positive indicator $D_1$ is only generated if the ratio at the two wavelengths exceeds the fire threshold and the correlation indicator $C_1$ is true.

The present invention may be embodied in other specific forms without departing from the spirit or essential attributes thereof, and it is therefore desired that the present embodiment be considered in all respects as illustrative and not restrictive, reference being made to the appended claims rather than to the foregoing description to indicate the scope of the invention.

What is claimed:

1. A method for detecting a fire in the presence of a false fire source, comprising the steps of:

(a) receiving a total radiant energy from both fire and non-fire sources at a first wavelength during a measurement time interval, and converting the total radiant energy at the first wavelength to a first electrical signal, (b) receiving a total radiant energy the both fire and non-fire sources at a second wavelength during the measurement time interval, and converting the total radiant energy at the second wavelength to a second electrical signal, (c) extracting a magnitude of a flicker frequency signal in the first electrical signal at a plurality of flicker frequencies to produce a first magnitude at each flicker frequency, (d) extracting a magnitude of a flicker frequency signal in the second electrical signal at the same plurality of flicker frequencies to produce a second magnitude at each flicker frequency, (e) calculating a ratio of the first magnitude to the second magnitude for each flicker frequency, (f) comparing the ratio at each flicker frequency to a first threshold and generating a ratio indicator if the ratio exceeds the first threshold, (g) correlating the flicker frequency signal at the first wavelength with the flicker frequency signal at the second wavelength at each flicker frequency and generating a correlation indicator if the correlation is positive, and (h) generating a positive indicator at each flicker frequency if the ratio indicator and the correlation indicator are both present.

2. The method of claim 1, further comprising a step of:

generating a fire indicator if the number of positive indicators exceeds a second threshold.

3. The method of claim 1, further comprising a step of:

feeding back a signal to steps (c) and (d) to alter the plurality of flicker frequencies, and measurement time interval.

4. The method of claim 1, wherein step (c) further comprises:

(1) multiplying the first electrical signal times a time-varying window function to form a first test signal, (2) calculating a discrete Fourier transform of the first test signal at each flicker frequency over the measurement time interval at a number of sample points in the measurement time interval according to the equation:

$$Ft_f = \frac{1}{P}\sum_{n=0}^{P-1} \text{test}\left(\cos\left(2\Pi\frac{Fn}{P}\right) - j\sin\left(2\Pi\frac{Fn}{P}\right)\right)$$

wherein test is the first test signal, F is the flicker frequency in Hertz, n is the sample point, P is the number of sample points in the time interval, and (3) calculating the first magnitude as the square root of the sum of the squares of the real and imaginary parts of the discrete Fourier transform.

5. The method of claim 4, wherein step (d) further comprises:

(1) multiplying the second electrical signal times a time-varying window function to form a second test signal, (2) calculating a discrete Fourier transform of the second test signal at each flicker frequency over the measurement time interval at a number of sample points in the measurement time interval according to the equation:

$$Ft_f = \frac{1}{P}\sum_{n=0}^{P-1} \text{test}\left(\cos\left(2\Pi\frac{Fn}{P}\right) - j\sin\left(2\Pi\frac{Fn}{P}\right)\right)$$

wherein test is the second test signals F is the flicker frequency in Hertz, n is the sample point, and P is the number of sample points in the time interval, and (3) calculating the second magnitude as the square root of the sum of the squares of the real and imaginary parts of the discrete Fourier transform.

6. The method of claim 1, wherein step (c) further comprises:

(1) multiplying the first electrical signal being a composite signal composed of sinusoids of the form V1+sin(A) where A is a flicker frequency and V1 is a direct current voltage, times a plurality of sinusoids of the form V2+sin(B) and a plurality of sinusoids of the form V2+cos(B) where B is an internally generated flicker frequency and V2 is a direct current voltage, resulting in a plurality of pairs of expressions of the form:

$$V1 \cdot V2 + V1 \cdot \sin(B) + V2 \cdot \sin(A) + \frac{1}{2}\,[\cos(A-B) - \cos(A+B)] \text{ and}$$

$$V1 \cdot V2 + V1 \cdot \cos(B) + V2 \cdot \sin(A) + \frac{1}{2} + [\sin(A+B) + \sin(A-B)]$$

(2) removing all direct current terms (V1·V2, V1·sin(B), V2·sin(A), and V1·cos(B)), (3) filtering the pair of expressions through lowpass filters set to reject frequencies greater than A−B, and (4) calculating the first magnitude as the square root of the sum of the squares of the outputs of the lowpass filters.

7. The method of claim 1, wherein step (d) further comprises:

(1) multiplying the second electrical signal being a composite signal composed of sinusoids of the form V1+sin (A) where A is a flicker frequency and VI is a direct current voltage, times a plurality of sinusoids of the form V2+sin(B) and a plurality of sinusoids of the form V2+cos(B) where B is an internally generated flicker frequency and V2 is a direct current voltage, resulting in a plurality of pairs of expressions of the form:

$$V1 \cdot V2 + V1 \cdot \sin(B) + V2 \cdot \sin(A) + \frac{1}{2}\,[\cos(A-B) - \cos(A+B)] \text{ and}$$

$$V1 \cdot V2 + V1 \cdot \cos(B) + V2 \cdot \sin(A) + \frac{1}{2} + [\sin(A+B) + \sin(A-B)]$$

(2) removing all direct current terms (V1·V2, V1·sin(B), V2·sin(A), and V1·cos(B)), (3) filtering the pair of expressions through lowpass filters set to reject frequencies greater than A−B, and (4) calculating the second magnitude as the square root of the sum of the squares of the outputs of the lowpass filters.

8. The method of claim 5, wherein step (g) further comprises the steps of:

(1) comparing the product of the real part of the discrete Fourier transform of claim 4 and imaginary part of the discrete Fourier transform of claim 5 to the product of the imaginary part of the discrete Fourier transform of claim 4 and the real part of the discrete Fourier transform of claim 5, and (2) generating the correlation indicator if the comparison is true.

9. The method of claim 8, wherein the correlation indicator is generated only if the second magnitude exceeds a third threshold.

10. The method of claim 4 where the window function is:

$$Vhan_n = \tfrac{1}{2}\,(1-\cos(2\Pi n/P),\ n=0\ldots P-1.$$

11. The method of claim 4 wherein the window function is:

$$ham_n = \alpha-(1-\alpha)(\cos(2\Pi n/P)),\ n=0\ldots P-1.$$

12. The method of claim 4 wherein the window function is:

$$black_m = \{1-[0.42+(0.5\cos(2\Pi n/p)+0.08\cos(4\Pi n/P]\}.\ n=0\ldots P-1.$$

13. The method of claim 5 where the window function is:

$$Vhan_n = \tfrac{1}{2}\,(1-\cos(2\Pi n/P),\ n=0\ldots P-1.$$

14. The method of claim 5 wherein the window function is:

$$ham_n = \alpha(1-\alpha)(\cos(2\Pi n/P)),\ n=0\ldots P-1.$$

15. The method of claim 5 wherein the window function is:

$$black_m = \{1-[0.42+(0.5\cos(2\Pi n/p)+0.08\cos(4\Pi n/P]\},.\ n=0\ldots P-1.$$

16. Apparatus for detecting a fire in the presence of a false fire source, comprising:

first and second detectors to detect total radiant energy of both fire and non-fire sources at first and second wavelengths respectively and to produce respective first and second electrical signals in response thereto;

first and second flicker filters coupled respectively to the first and second detectors to filter the respective first and second electrical signals at a selected flicker frequency to produce first and second filtered signals;

a flicker frequency generator coupled to the first and second flicker frequency filters to select the flicker frequency from a plurality of flicker frequencies;

a ratio circuit to produce a ratio signal from the first and second filtered signals; and a comparator coupled to the ratio circuit to receive the ratio signal and produce a ratio indicator if the ratio signal exceeds a first threshold.

17. Apparatus as recited in claim 16, further comprising a correlator coupled to the first and second flicker filters to generate a correlation between the first and second filtered signals at each selected flicker frequency, and to generate a correlation indicator where the correlation is positive.

18. Apparatus as recited in claim 17, further comprising a positive indicator, coupled to the comparator and the correlator to produce a positive indicator when both the ratio indicator and the correlation indicator are present.

19. Apparatus as recited in claim 16, further comprising a cross power calculator coupled to the first and second detectors to generate a cross power signal, and an adaptive controller coupled to receive the cross power signal and coupled to control the flicker frequency generator by selecting a number of flicker frequencies and values of the flicker frequencies to be included in the plurality of flicker frequencies.

20. Apparatus as recited in claim 19, wherein the adaptive controller is coupled to select a bandwidth of the first and second flicker filters.

21. Apparatus as recited in claim 20, wherein the adaptive controller is coupled to window the first and second electrical signals using a function selected from the group consisting of a Blackman function, a Hamming function and a Von Han function.

22. Apparatus for detecting a fire in the presence of a plurality of false fire sources, comprising:

first and second detectors to detect total radiant energy of both fire and non-fire sources at first and second wavelengths respectively and to produce respective first and second electrical signals in response thereto;

a sinusoidal generator to generate sine and cosine signals at a selected flicker frequency, and adapted to multiply the first and second electrical signals by the sine and cosine signals separately to produce a first sine signal, a first cosine signal, a second sine signal and a second cosine signal;

integrators coupled to integrate each of the first sine and cosine signals and the second sine and cosine signals individually;

a first magnitude circuit coupled to the first sine and cosine signals to produce a first magnitude signal, the first magnitude signal indicating a magnitude of the total radiant energy at the first wavelength at the selected flicker frequency;

a second magnitude circuit coupled to the second sine and cosine signals to produce a second magnitude signal, the second magnitude signal indicating a magnitude of the total radiant energy at the second wavelength at the selected flicker frequency;

a comparator coupled to the first and second magnitude circuits to generate a ratio in response to the first and second magnitude signals and to compare the ratio with a first fire threshold level to produce a first comparison signal; and an indicator to indicate the presence of a fire in response to the first comparison signal.

23. Apparatus as recited in claim 22, wherein the first and second magnitude circuits each include squaring circuits to generate respective squared sine and cosine signals, an adding circuit to add the respective squared sine and cosine signals to produce an added signal and a root circuit to produce the magnitude signal from the added signal.

24. Apparatus as recited in claim 22, further comprising a ratio circuit coupled to form a first ratio from the first sine signal and the second cosine signal and a second ratio from the first cosine signal and the second sine signal, and a phase comparison circuit to compare the first and second ratios to produce a phase comparison signal, the indicator coupled to the phase comparison circuit to indicate the presence of a fire in response to the phase comparison signal.

25. Apparatus as recited in claim 24, further comprising a magnitude comparator to compare a magnitude of one of the first and second magnitude signals with a second threshold signal and to generate a magnitude level signal in response thereto, the indicator being coupled to the magnitude comparator to indicate the presence of a fire in response to the magnitude level signal.

26. Apparatus as recited in claim 22, further comprising a timing controller, coupled to control timing of the sinusoidal generator and the integrators.

27. Apparatus as recited in claim 26, further comprising a window function generator, coupled to window the first and second electrical signals so as to selected a flicker frequency bandwidth, the timing generator coupled to the window function generator to control the window function.

28. Apparatus as claimed in claim 27, wherein the window function generated by the window function generator is one of the group consisting of a Blackman function, a Hamming function and a Von Han function.

* * * * *